US008704810B2

(12) United States Patent
Tsuchi

(10) Patent No.: US 8,704,810 B2
(45) Date of Patent: Apr. 22, 2014

(54) SEMICONDUCTOR DEVICE AND DATA DRIVER OF DISPLAY APPARATUS USING THE SAME

(75) Inventor: Hiroshi Tsuchi, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 983 days.

(21) Appl. No.: 12/662,459

(22) Filed: Apr. 19, 2010

(65) Prior Publication Data

US 2010/0271348 A1 Oct. 28, 2010

(30) Foreign Application Priority Data

Apr. 22, 2009 (JP) ..... 2009-104454

(51) Int. Cl.
*G09G 5/00* (2006.01)

(52) U.S. Cl.
USPC ..... 345/205

(58) Field of Classification Search
USPC ..... 345/94–100, 204–205; 365/49.1–49.18
See application file for complete search history.

(56) References Cited

U.S. PATENT DOCUMENTS

| | | | | |
|---|---|---|---|---|
| 5,130,666 | A | 7/1992 | Nicollini | |
| 5,396,245 | A | 3/1995 | Rempfer | |
| 6,246,351 | B1 | 6/2001 | Yilmaz | |
| 6,320,777 | B1 * | 11/2001 | Lines et al. | 365/49.12 |
| 6,552,710 | B1 * | 4/2003 | Shimizu et al. | 345/100 |
| 6,731,170 | B2 | 5/2004 | Juang | |
| 7,368,990 | B2 | 5/2008 | Tsuchi | |
| 7,639,167 | B2 | 12/2009 | Tsuchi | |
| 7,969,342 | B2 | 6/2011 | Tsuchi | |
| 2002/0141227 | A1 * | 10/2002 | Ema | 365/149 |
| 2002/0196081 | A1 | 12/2002 | Nguyen et al. | |
| 2003/0071777 | A1 | 4/2003 | Kokubun et al. | |
| 2010/0052966 | A1 | 3/2010 | Tsuchi | |

FOREIGN PATENT DOCUMENTS

| | | |
|---|---|---|
| CN | 1383123 (A) | 12/2002 |
| CN | 1790900 (A) | 6/2006 |
| JP | 2000-156639 | 6/2000 |
| JP | 2000-163018 | 6/2000 |
| JP | 2006-174180 | 6/2006 |

OTHER PUBLICATIONS

Chinese Office Action dated Nov. 4, 2013.

* cited by examiner

*Primary Examiner* — Yong H Sim
(74) *Attorney, Agent, or Firm* — McGinn IP Law Group, PLLC

(57) ABSTRACT

There is provided a decoder in which a matrix of transistors, a plurality of reference voltage signal lines arranged on a first interconnect layer and extended in a row direction, being separated to one another over the matrix, and a plurality of reference voltage signal lines arranged on a second interconnect layer and extended in the row direction, being separated to one another over the matrix. The reference voltage signal lines on the mutually different layers are respectively connected to impurity diffusion layers of the transistors that are adjacent in the row direction. The reference voltage signal lines on the mutually different layers are respectively connected to the impurity diffusion layers of the transistors that are adjacent in a column direction.

15 Claims, 18 Drawing Sheets

FIG. 13 10-k

REFERNCE CASE

REFERNCE CASE

SEMICONDUCTOR DEVICE AND DATA DRIVER OF DISPLAY APPARATUS USING THE SAME

REFERENCE TO RELATED APPLICATION

This application is based upon and claims the benefit of the priority of Japanese patent application No. 2009-104454 filed on Apr. 22, 2009, the disclosure of which is incorporated herein in its entirety by reference thereto.

TECHNICAL FIELD

The present invention relates to a semiconductor device, and a data driver of a display apparatus using the semiconductor device.

BACKGROUND

Recently, a demand for flat-panel display apparatuses for use in large-screen display TV sets as well as portable telephones (such as mobile phones or cellular phones), notebook PCs, and monitors has expanded. For these display apparatuses, a liquid crystal or an organic EL is employed as a display device. An active matrix driving scheme is mainly adopted as a driving scheme of these display apparatuses. FIG. 17 schematically shows a typical configuration of a main portion connected to a pixel in a display unit of the display apparatus of the active matrix driving scheme. Referring to FIG. 17, the display apparatus of the active matrix driving scheme will be outlined.

Generally, a display unit 960 of the display apparatus of the active matrix driving scheme includes a semiconductor substrate on which pixel units 964 and thin-film transistors (TFTs) 963 are arranged in a matrix form (of 1280×RGB pixel columns×1024 pixel rows in the case of a color SXGA (Super Extended Graphics Array) panel, for example). In the case of a liquid crystal display apparatus, each pixel unit 964 includes a transparent electrode provided for each pixel unit and a liquid crystal sealed in between the semiconductor substrate and an opposing substrate provided facing the semiconductor substrate. One transparent electrode is formed on an entire surface of the opposing substrate. In the case of an organic EL display apparatus, the pixel unit 964 further includes a thin-film transistor that controls an organic EL element and current that flows through the organic EL element.

Turning on and off of a TFT 963 having a switching function is controlled by a scan signal. When the TFT 963 is turned on, a gray scale voltage signal corresponding to a video data signal is supplied to the pixel unit 964. The gray scale voltage signal acts on the display device of each pixel unit, and brightness of each pixel unit is controlled. Display is thereby performed. In the case of the liquid crystal display apparatus, transmittance of the liquid crystal is changed by a potential difference between the gray scale voltage signal supplied to the pixel unit 964 and an opposing substrate voltage with respect to a back light inside the display apparatus. Display is thereby performed. On the other hand, in the case of the organic EL display apparatus, the thin-film transistor that controls the current according to the gray scale voltage signal supplied to the pixel unit 964 controls the current that flows through the organic EL element. Light-emitting brightness of the organic EL element is changed according to the current. Display is thereby performed. There are some organic EL display apparatuses where a current signal is directly supplied to the pixel unit from a driver. This specification handles the display apparatus where the gray scale voltage signal is supplied from the driver and the gray scale voltage signal is converted to the current signal at the pixel unit.

The scan signal is supplied to a scan line 961 from a gate driver 970, and a grayscale signal voltage is supplied to each pixel unit 964 from a data driver 980 through a data line 962. The gate driver 970 and the data driver 980 are controlled by a display controller 950. A clock CLK, and a control signal that are necessary are supplied from the display controller 950 to each of the gate driver 970 and the data driver 980, and video data is supplied to the data driver 980. A supply voltage is given to each of the data driver 980 and the gate driver 970 from a power supply circuit 940. It is assumed that the video data that will be supplied to the data driver 980 is digital data.

Rewriting of data of one screen is performed in one frame period (of approximately 0.017 seconds, when driving at 60 Hz is performed). Data is successively selected every pixel row (every line) by each scan line, and the gray scale voltage signal is supplied to the pixel unit 964 from each data line within a selection period. There are also a configuration in which a plurality of pixel rows are simultaneously selected by a plurality of scan lines and a configuration in which driving is performed at a frame frequency of 60 Hz or more.

While the gate driver 970 needs to supply the scan signal of a binary value, the data driver 980 needs to drive the data line by the gray scale voltage signal of multi-valued levels in accordance with the number of gray scales. The data driver 980 includes, for each data line, a decoder that converts the video data to an analog voltage and an amplifier circuit that amplifies the analog voltage to output the so amplified analog voltage to the data line 962.

FIG. 18 is a block diagram showing a main portion of the data driver 980 in FIG. 17. The configuration of the data driver will now be described with reference to FIG. 18.

As shown in FIG. 18, the data driver 980 includes a shift register unit 16, a data register & latch unit 15, a level shifter group 14, a decoder group 10, a reference voltage generation circuit 11, an amplifier circuit group 12, a bias circuit 13, and output terminals S1 to Sq connected to a plurality of data lines (indicated by reference numeral 962 in FIG. 17), respectively.

The shift register unit 16 determines a data latch timing corresponding to an output, based on the clock signal CLK and a start signal. The data register & latch unit 15 receives video digital data, latches the digital data based on the timing determined by the shift register unit 16, and outputs the latched digital data to the level shifter group 14, responsive to a timing of an STB (strobe) signal. The level shifter group 14 converts low voltage signals received as bit data for respective outputs to high voltage signals and outputs the high voltage signals to the decoder group 10. Each of the shift register unit 16 and the data register & latch unit 15 includes a logic circuit, and is generally driven by a low voltage (0 to 3.3 V).

The reference voltage generation circuit 11 generates a plurality of reference voltage signals having mutually different levels determined according to the number of gray scales, and supplies the reference voltage signals to the decoder group 10. The decoder group 10 includes a plurality of decoder circuits corresponding to the number of the outputs. Each decoder selects the reference voltage signal corresponding to bit data output from the level shifter 14 and supplies the selected reference voltage signal to a corresponding amplifier circuit of the amplifier circuit group 12. Each amplifier circuit of the amplifier circuit group 12 receives a bias signal from the bias circuit 13, and amplifies and outputs a gray scale voltage signal to a corresponding output terminal of the output terminal group S1 to Sq, based on the reference voltage signal selected by each decoder of the decoder group 10. The number of gray scales is generally set to a power of two. The exponent of the power corresponds to the number of bits of data. When the number of bits is eight, the number of gray scales becomes 256, which is the eighth power of two.

Each decoder of the decoder group 10 includes a plurality of reference voltage lines of multi-valued (m-ary) levels corresponding to the number of gray scales and a plurality of switch transistors. The switch transistors controlled to be turned on and off according to data (binary data) of a predetermined number of bits, and the reference voltage signal corresponding to the data is selected from among reference voltage lines 70 of the multi-valued levels.

In recent years, the number of display colors has increased due to enhanced quality of a display apparatus. The number of display colors depends on the number of bits of video digital data and the number of voltage levels (number of gray scales) of gray scale voltage signals output from output amplifiers. In recent years, not only the number of display apparatuses for 6-bit data (64 gray scales), but also the number of display apparatuses for 8-bit data (256 gray scales) has increased. Further, display apparatuses for 10-bit data (1024 gray scales) have also been developed.

When the number of bits of data increases by two, the number of gray scales is quadrupled. The number of reference voltage lines and the number of switch transistors also increase according to the increase in the number of gray scales. Accordingly, the area of a decoder significantly increases, which significantly influences an increase in the chip cost of a data driver.

It is also demanded that the number of outputs per chip be increased and the number of driver LSIs mounted on the display apparatus be thereby reduced so as to reduce the cost of the driver mounted on the display apparatus.

With the increase in the number of outputs per chip, the necessity for narrowing pitches of each circuit corresponding to the number of outputs increases. In order to cope with these demands, there is an urgent need to reduce the area of the decoder group 10.

Patent Document 1 discloses a configuration of a decoder (ROM decoder) in which enhancement-type transistors and depletion-type transistors are arranged as a matrix and are divided into two decoders, in order to reduce the short-length direction size and area of a chip and to achieve reduction of the production cost reduction and reduction of the frame size of a liquid crystal display module. Patent Document 2 discloses a configuration of a digital-to-analog conversion circuit in which an amplifier that interpolates two reference voltages and amplifies and outputs a resulting voltage is employed in an amplifier circuit to reduce the number of reference voltages selected by a decoder and the area of the decoder.

[Patent Document 1] JP Patent Kokai Publication No. JP-P2000-163018A (FIG. 3)

[Patent Document 2] JP Patent Kokai Publication No. JP-P2006-174180A (FIG. 7)

SUMMARY

The above Patent Documents are incorporated herein by reference thereto. The following analysis is given by the present invention.

In recent years, the number of gray scales (the number of bits of video digital data) of a display driver has increased. Further, reduction of the area of a chip using a fine process has been strongly demanded so as to achieve cost reduction. The smaller the number of metal layers, the lower the cost of the process is. However, even if the number of metal layers has been increased, the chip cost can be reduced if the area of the chip can be greatly reduced.

An object of the present invention is to provide a decoder that achieves area saving, and an area-saving data driver that uses the decoder.

Another object of the present invention is to provide a data driver that can cope with pitch reduction of a decoder circuit corresponding to the increase of the number of outputs of the data driver.

The present invention, which solves one or more of the problems, may be summarized as follows.

According to the present invention, there is provided a semiconductor device comprising: a first region including first, second, third, and fourth transistors arranged in a 2×2 matrix, wherein, relating to a row and a column of the 2×2 matrix in which the first transistor is arranged, the second transistor is arranged in the same row and the other column, the third transistor is arranged in the other row and the same column, and the fourth transistor is arranged in the other row and the other column; first and second signal lines arranged on a first interconnect layer, separated to each other and extended in the row direction over the 2×2 matrix; and third and fourth signal lines arranged on a second interconnect layer which is different from the first interconnect layer, separated to each other and extended in the row direction over the 2×2 matrix. The first and second signal lines and the third and fourth signal lines are provided in association with the first region. The first transistor has a first impurity diffusion layer connected to the first signal line on the first interconnect layer, the second transistor has a first impurity diffusion layer connected to the third signal line on the second interconnect layer, the third transistor having a first impurity diffusion layer connected to the fourth signal line on the second interconnect layer, and the fourth transistor having a first impurity diffusion layer connected to the second signal line on the first interconnect layer.

In the present invention, the first and third transistors have respective gate electrodes connected in common to a first binary input signal. The second and fourth transistors have respective gate electrodes connected in common to a second binary input signal. The first and second input signals are complementary to each other. The first and second transistors have second impurity diffusion layers coupled together at a first node to which a signal on the first signal line or the third signal line being transmitted via the first or second transistor made conductive responsive to the first and second binary input signals. The third and fourth transistors have second impurity diffusion layers coupled together at a second node, to which a signal on the second signal line or the fourth signal line being transmitted via the third or fourth transistor made conductive responsive to the first and second binary input signals.

In the semiconductor device according to the present invention, there are provided a second region having fifth to eighth transistors arranged in a 2×2 matrix, wherein, relating to a row and a column of the 2×2 matrix in which the fifth transistor is arranged, the sixth transistor is arranged in the same row and the other column, the seventh transistor is arranged in the other row and the same column, and the eighth transistor is arranged in the other row and the other column. There are also provided fifth and sixth signal lines arranged on the first interconnect layer, separated to each other and extended in the row direction over the 2×2 matrix, and seventh and eighth signal lines arranged on the second interconnect layer, separated to each other and extended in the row direction over the 2×2 matrix. The fifth and sixth signal lines and the seventh and eighth signal lines are provided in association with the second region. The fifth transistor has a first impurity diffusion layer connected to the fifth signal line on the first interconnect layer, the sixth transistor has a first impurity diffusion layer connected to the seventh signal line on the second interconnect layer, the seventh transistor has a first impurity diffusion layer connected to the eighth signal line on the second interconnect layer, and the eighth transistor has a first impurity diffusion layer connected to the sixth signal line on the first interconnect layer.

In the present invention, the fifth and seventh transistors have respective gate electrodes connected in common to a third binary input signal. The sixth and eighth transistors have respective gate electrodes connected in common to a fourth binary input signal. The third and fourth input signals are complementary to each other. The fifth transistor and the sixth transistor have second impurity diffusion layers coupled together at a third node to which a signal on the fifth signal line or the seventh signal line being transmitted via the fifth or sixth transistor made conductive responsive to the third and fourth binary input signals. The seventh transistor and the eighth transistor have second impurity diffusion layers coupled together at a fourth node, from which a signal on the sixth signal line or the eighth signal line being transmitted via the seventh or eighth transistor made conductive responsive to the third and fourth binary input signals.

In the present invention, the first signal line on the first interconnect layer has a layout pattern which overlaps at least partially with a layout pattern of the third signal line on the second interconnect layer, and the second signal line on the first interconnect layer has a layout pattern which overlaps at least partially with a layout pattern of the fourth signal line on the second interconnect layer.

In the present invention, the fifth signal line on the first interconnect layer has a layout pattern which overlaps at least partially with a layout pattern of the seventh signal line on the second interconnect layer, and the sixth signal line on the first interconnect layer has a layout pattern which overlaps at least partially with a layout pattern of the eighth signal line on the second interconnect layer. In the present invention, on the first interconnect layer above the first and second regions, the first signal line and the fifth signal line are adjacent to each other, and the second signal line and the sixth signal line on the first interconnect layer are adjacent to each other, and on the second interconnect layer above the first and second regions, the third signal line and the seventh signal line are adjacent to each other, and the fourth signal line and the eighth signal line on the second interconnect layer are adjacent to each other.

According to the present invention, there is provided a semiconductor comprising: a decoder including: one or a plurality of the 2×2 matrices in the first region arranged in the column direction thereof; one or a plurality of the 2×2 matrices in the second region arranged in the column direction thereof; and a selection circuit unit that receives the signals at the first and second nodes of the first region and the signals at the third and fourth nodes of the second region and selects one of the signals on one or more the nodes, corresponding to a binary input signal received, the selection circuit unit being arranged between the first and second regions. In the present invention, there may be provided a plurality of decoders arranged on an extension line in the row direction of the 2×2 matrices. The decoder may have the first and second regions respectively arranged on both sides of the decoder, with the selection circuit unit being arranged between the first and second regions. The decoder may share a first through-hole that is for connecting the first signal line on the first interconnect layer and the first impurity diffusion layer of the first transistor and a second through-hole that is for connecting the fourth signal line on the second interconnect layer and the first impurity diffusion layer of the third transistor with the decoder adjacently arranged on a side of the first region. The decoder may share a third through-hole that is for connecting the fifth signal line on the first interconnect layer and the first impurity diffusion layer of the fifth transistor and a fourth through-hole that is for connecting the eighth signal line on the second interconnect layer and the first impurity diffusion layer of the seventh transistor with the decoder adjacently arranged on a side of the second region. The decoder and the adjacent decoder on the side of the first region may share the respective first impurity diffusion layers of the first and third transistors. The decoder and the adjacent decoder on the side of the second region may share the respective first impurity diffusion layers of the fifth and seventh transistors.

According to the present invention, there is provided a data driver comprising: a decoder corresponding to one driver output; a data signal with a predetermined number of bits and first to eighth signal lines; a first region including first to fourth transistors adjacently arranged in a row direction and a column direction; and a second region including fifth to eighth transistors adjacently arranged in the row direction and the column direction; the first to eighth signal lines comprising four signal lines on a first interconnect layer and four signal lines on a second interconnect layer which are placed over the four signal lines on a first interconnect layer, the first to fourth transistors in the first region being supplied with signals from two signal lines on the first interconnect layer and two signals from two signal lines on the second interconnect layer, the two signal lines on the first interconnect layer and the two signal lines on the second interconnect layer being among the first to eighth signal lines, a transistor pair among the adjacent transistor pairs which are adjacent in the row direction and adjacent transistor pairs which are adjacent in the column direction, being supplied with the signals from the interconnect layers that are different, signals being respectively supplied to the fifth to eight transistors in the second region through two of the signal lines on the first interconnect layer and two of the signal lines on the second interconnect layer different from the signal lines used for the first to fourth transistors, and a transistor pair among the adjacent transistor pairs which are adjacent in the row direction and adjacent transistor pairs which are adjacent in the column direction, being supplied with the signals from the interconnect layers that are different, the first to eight transistors selecting and outputting a signal corresponding to a predetermined bit data signal among the signals supplied through the first to eighth signal lines.

In the present invention, the four signal lines on the first interconnect layer are arranged adjacent to one another within the same interconnect layer and the four signal lines on the second interconnect layer are arranged adjacent to one another within the same interconnect layer.

In the present invention, the four signal lines on the first interconnect layer and the four signal lines on the second interconnect layer have overlapping potions in layout patterns thereof.

In the present invention, the first and second interconnect layers are formed on layers above the first to eighth transistors in the first and second regions; a third interconnect layer is further provided as an intermediate layer between the first to eight transistors and the first and second interconnect layers; and the first to third interconnect layers are different from a layer of gates of the first to eighth transistors and includes three interconnect layers closest to the first to eighth transistors.

In the present invention, the decoder comprises a plurality of the decoders corresponding to a plurality of driver outputs; and a plurality of the signal lines are shared between a plurality of the decoders.

In the decoder according to the present invention, there are provided: first to fourth transistors arranged in a first region, the first to fourth transistors forming a 2×2 matrix; and fifth to eighth transistors arranged in a second region, the fifth to eighth transistors forming a 2×2 matrix, the second region being obtained by moving the first region in parallel. In the present invention, a first interconnect layer comprises first to fourth voltage signal lines that extend in a row direction; and a second interconnect layer comprises first to fourth voltage signal lines that extend in the row direction. In the first region, gates of the first and third transistors arranged in a column direction are connected in common to a first binary signal, and gates of the second and fourth transistors arranged in the column direction are connected in common to a second binary signal. The first transistor has a first impurity diffusion layer of connected to the first voltage signal line on the first interconnect layer, the third transistor has a first impurity diffusion layer connected to the third voltage signal line on the second interconnect layer, the second transistor has a first impurity diffusion layer connected to the first voltage signal line on the second interconnect layer, the fourth transistor has a first impurity diffusion layer connected to the third signal line on the first interconnect layer. In the second region, gates of the fifth and seventh transistors arranged in the column direction are connected in common to a third binary signal, and gates of the sixth and eighth transistors arranged in the column direction are connected in common to a fourth binary signal. The fifth transistor has a first impurity diffusion layer of the fifth transistor connected to the second voltage signal line on the first interconnect layer, the seventh transistor has a first impurity diffusion layer connected to the fourth voltage signal line on the second interconnect layer, the sixth transistor has a first impurity diffusion layer connected to the second voltage signal line on the second interconnect layer, and the eighth transistor has a first impurity diffusion layer of connected to the fourth signal line on the first interconnect layer.

The present invention provides a decoder that achieves area saving, and an area-saving (low-cost) data driver that uses the decoder. The present invention provides a data driver capable of accommodating reduction of pitches of the decoders corresponding to the number of outputs. Still other features and advantages of the present invention will become readily apparent to those skilled in this art from the following detailed description in conjunction with the accompanying drawings wherein only exemplary embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTIONS OF THE DRAWINGS

PREFERRED MODES

Figure 1:
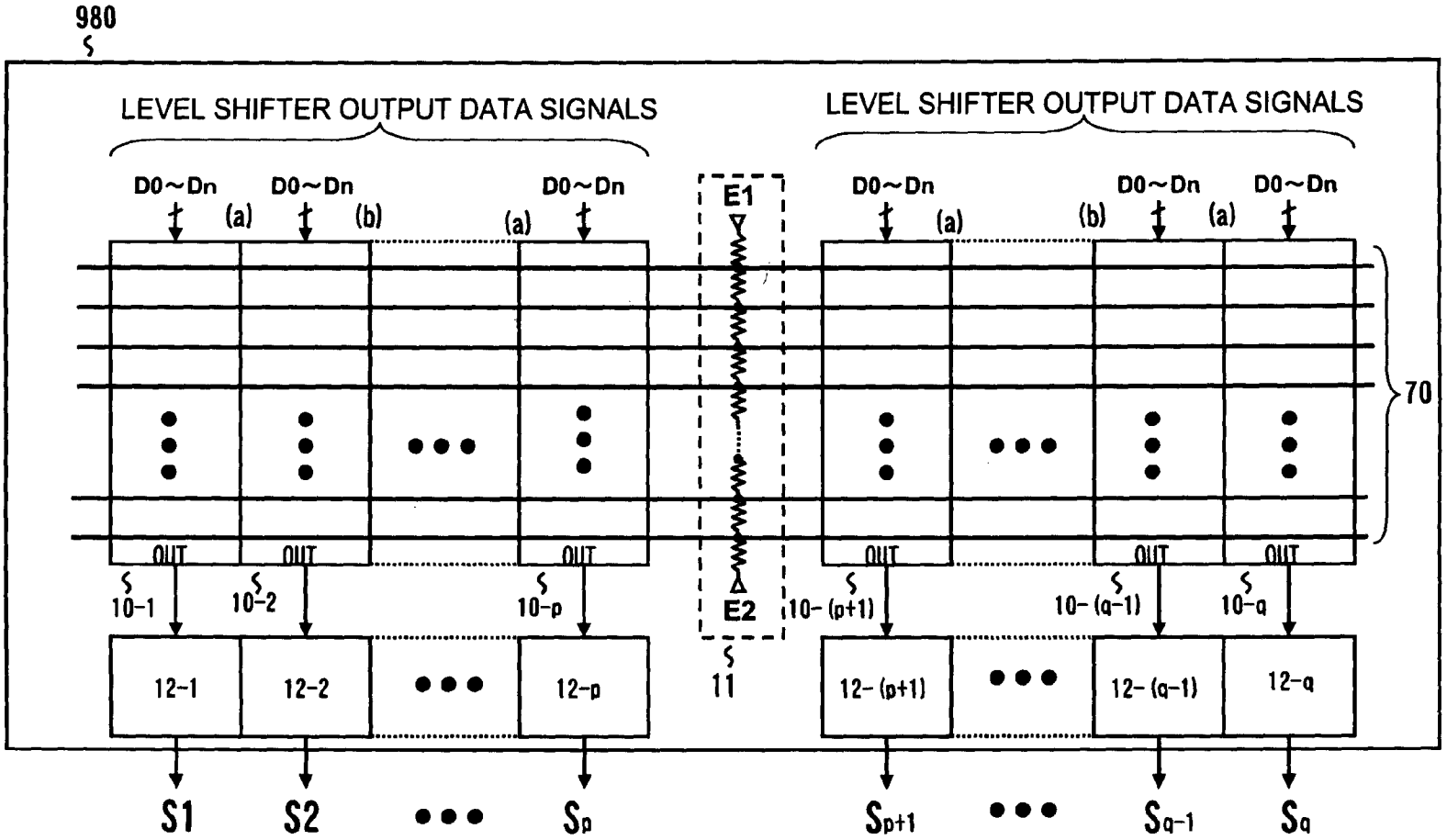
FIG. 1 is a diagram showing a configuration of an exemplary embodiment of the present invention.

Exemplary embodiments of the present invention will be described. In a decoder according to the present invention, there are provided fourth transistors (indicated by reference numerals 21 to 24 in FIG. 3) that are arranged in a 2×2 matrix. With respect to the row and the column of the first transistor (21) in the 2×2 matrix, the second transistor (22) is arranged on the same row and the other column, the third transistor (23) is arranged on the same column and the other row, and the fourth transistor (24) is arranged on the other row and the other column. There are also provided first and second signal lines (indicated by reference numerals 71-1 and 71-3 in FIG. 4A, for example) arranged on a first interconnect layer (71), and third and fourth signal lines (indicated by reference numerals 72-1 and 72-3 in FIG. 4B, for example) arranged on a second interconnect layer (72) which is different from the first interconnect layer (71). The first and second signal lines are extended in a row direction, being separated to each other over the 2×2 matrix. The third and fourth signal lines are extended in the row direction, being separated to each other over the 2×2 matrix. The first transistor (21) has a first impurity diffusion layer of the first transistor (21) formed on a surface of a substrate and connected to the first signal line (71-1) on the first interconnect layer (71). The second transistor (22) has a first impurity diffusion layer formed on the surface of the substrate and connected to the third signal line (72-1) on the second interconnect layer (72). The third transistor (23) has a first impurity diffusion layer formed on the surface of the substrate and connected to the fourth signal line (72-3) on the second interconnect layer (72). The fourth transistor (24) has a first impurity diffusion layer formed on the surface of the substrate and connected to the second signal line (71-3) of the first interconnect layer (71). In the present invention, the first and third transistors (21 and 23) have respective gate electrodes connected in common to a first binary input signal. The second and fourth transistors (22 and 24) have respective gate electrodes connected in common to a second binary input signal. The first input signal and the second input signal are complementary to each other. The first and second transistors (21 and 22) have second impurity diffusion layers formed on the surface of the substrate and coupled together at a first node (N12). A signal on the first signal line (71-1) or the third signal line (72-1) is transmitted to the first node (N12) via the first transistor or the second transistor (21 or 22) which is made conductive responsive to the first and second binary input signals. The third and fourth transistors (23 and 24) have second impurity diffusion layers formed on the surface of the substrate and coupled together at a second node (N15). A signal on the second signal line (71-3) or the fourth signal line (72-3) is transmitted to the second node (N15) via the third transistor or the fourth transistor (23 or 24) which is made conductive responsive to the first and second binary input signals.

In the decoder according to the present invention, there are provided fifth to eighth transistors (indicated by reference numerals 31 to 34) that are arranged in a 2×2 matrix in a second region at a position corresponding to the position of the first region, for example, moved in parallel in the row direction. With respect to the row and the column of the fifth transistor (31) in the 2×2 matrix, the sixth transistor (32) is arranged on the same row and the other column, the seventh transistor (33) is arranged on the same column and the other row, and the eighth transistor (34) is arranged on the other row and the other column. There are also provided fifth and sixth signal lines (indicated by reference numerals 71-2 and 71-4) arranged on the first interconnect layer (71), and seventh and eighth signal lines (indicated by reference numerals 72-2 and 72-4) arranged on the second interconnect layer (72). The fifth and sixth signal lines are extended in the row direction, being separated to each other over the matrix. The seventh and eighth signal lines are extended in the row direction, being separated to each other over the 2×2 matrix. The fifth transistor (31) has a first impurity diffusion layer formed on the surface of the substrate and connected to the fifth signal line (71-2) on the first interconnect layer (71). The sixth transistor (32) has a first impurity diffusion layer formed on the surface of the substrate and connected to the seventh signal line (72-2) on the second interconnect layer (72). The seventh transistor (33) has a first impurity diffusion layer formed on the surface of the substrate and connected to the eighth signal line (72-4) on the second interconnect layer (72). The eighth transistor (34) has a first impurity diffusion layer formed on the surface of the substrate and connected to the sixth signal line (71-4) on the first interconnect layer. The fifth and seventh transistors (31, 33) have respective gate electrodes connected in common to a third binary input signal. The sixth and eighth transistors (32 and 34) have respective gate electrodes connected in common to a fourth binary input signal. The third input signal and the fourth input signal are complementary to each other. The fifth and sixth transistors (31 and 32) have second impurity diffusion layers coupled together at a third node (N22 in FIG. 3). A signal on the fifth signal line (71-2) or the seventh signal line (72-2) is transmitted to the third node (N22) via the fifth transistor or the sixth transistor (31 or 32) which is made conductive responsive to the third and fourth binary input signals. The seventh and eighth transistors (33 and 34) have respective second impurity diffusion layers coupled together at a fourth node (N25). A signal on the sixth signal line (71-4) or the eighth signal line (72-4) is transmitted to the fourth node (N25) via the seventh transistor or the eighth transistor (33 or 34) responsive to the third and fourth binary input signals.

In the decoder according to the present invention, there is provided a selection circuit unit (40) between the first and second regions. The selection circuit unit (40) receives signals at the first and second nodes (N12 and N15) of the first region and signals at the third and fourth nodes (N22 and N25) of the second region. The selection circuit unit (40) selects and outputs at least one of the signals, based on a corresponding fifth binary input signal.

In the present invention, at least portions of the first signal line (71-1) on the first interconnect layer and the third signal line (72-1) on the second interconnect layer (72) overlap on a plane seen from above the respective interconnect layers. At least portions of the second signal line (71-3) on the first interconnect layer and the fourth signal line (72-3) on the second interconnect layer overlap on the plane seen from above the respective interconnect layers. At least portions of the fifth signal line (71-2) on the first interconnect layer and the seventh signal line (72-2) on the second interconnect layer overlap on the plane seen from above the respective interconnect layers. At least portions of the sixth signal line (71-4) on the first interconnect layer and the eighth signal line (72-4) on the second interconnect layer overlap on the plane seen from above the respective interconnect layers. A description will be given below in connection with examples.

FIG. 1 is a diagram showing a configuration of a data driver 980 in an exemplary embodiment of the present invention. Referring to FIG. 1, the data driver 980 includes a decoder group 10, a reference voltage generation circuit 11, and an amplifier circuit group 12.

The decoder group 10 include first to qth decoders 10-1 to **10-*q* arranged corresponding to q output terminals S1** to Sq, respectively.

The amplifier circuit group 12 includes first to qth amplifier circuits 12-1 to **12-*q*, corresponding to the q output terminals S1** to Sq, respectively.

The reference voltage generation circuit 11 is arranged between the decoder group **10-*p* and 10-(*p*+1)** (where (p+1)≤q).

The reference voltage generation circuit 11 includes a resistor string that outputs divided voltages between a first voltage E1 and a second voltage E2 (in which E1>E2). Reference voltage signals having a plurality of mutually different voltage levels are generated at respective connection nodes (taps) of the resistor string.

The reference voltage signals having the plurality of levels are supplied to the decoders 10-1 to **10-*q* through reference voltage signal lines 70 common to all outputs S1** to Sq.

To each of the decoders 10-1 to **10-*q*, (n+1)-bit data signals D0 to Dn output from a level shifter for each output and complementary signals D0B to DnB of the data signals D0 to Dn are input. One or a plurality of the reference voltage signals corresponding to the (n+1)-bit data signals are selected and output from each terminal OUT. The reference voltage signals selected by the decoders 10-1 to 10-*q* are amplified and output from the amplifier circuits 12-1 to 12-*q* to the output terminals S1 to Sq, respectively. Each of the amplifier circuits 12-1 to 12-*q* is not limited to a configuration which receives one reference voltage signal and amplifies and outputs a corresponding gray scale voltage signal. Each of the amplifier circuits 12-1 to 12-*q* may have a configuration which receives a plurality of reference voltage signals, performs operation and amplification of the reference voltage signals and outputs a corresponding gray scale voltage signal. A configuration as disclosed in (FIG. 7 of) Patent Document 2 that receives two reference voltage signals and amplifies and outputs an intermediate voltage between the two reference voltage signals as a gray scale voltage signal may also be employed. On contrast therewith, each of the decoders 10-1 to 10-*q* in FIG. 1 is set to have a configuration which selects one or more reference voltage signals and outputs the selected one or more reference voltage signals from the terminal OUT. Referring to FIG. 1, the data signals D0B to Dn are illustrated as level shifter output signals. The complementary signals D0**B to DnB which are omitted are not illustrated.

Though not limited thereto, each of the first to qth decoders 10-1 to **10-*q* in FIG. 1** includes transistor switches of a same conductivity type. The adjacent decoders are mirror-arranged (arranged in mirror symmetry) using one of boundaries (a) and (b) as a symmetry axis. When the decoder on the left side of the boundary line (a) is folded back using the boundary line (a) as the axis, the decoder on the right side of the boundary line (a) is obtained. When the decoder on the left side of the boundary line (b) is folded back using the boundary line (b) as the axis, the decoder on the right side of the boundary line (b) is obtained.

Figure 2:
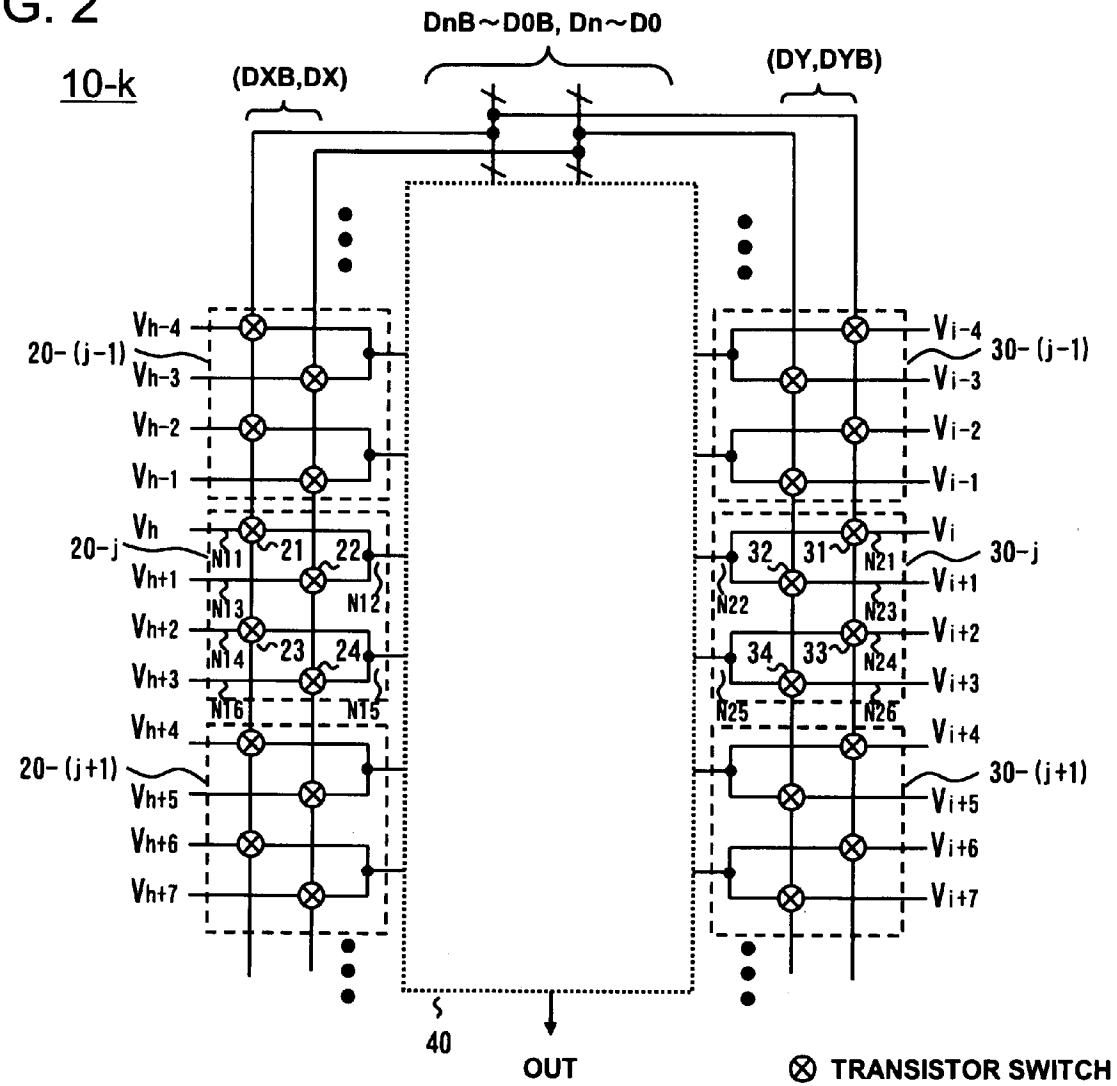
FIG. 2 is a diagram showing a configuration of an example of the present invention.

FIG. 2 is a diagram showing a circuit configuration of the decoder to which the present invention is applied. FIG. 2 is the diagram showing the configuration of a decoder **10-*k* (k being an arbitrary integer among 1 to q) corresponding to one output in FIG. 1**.

Referring to FIG. 2, the decoder **10-*k* receives (n+1) data signals D0 to Dn and the complementary signals D0B to DnB of the data signals D0 to Dn, selects the reference voltage signal corresponding to the received data signals, and outputs the selected reference voltage signal to the terminal OUT. FIG. 2 shows the detailed configuration of the selection circuit portions that use one-bit signal DX among the (n+1) bit data signals D0 to Dn and a complementary signal DXB of the one-bit signal DX among the complementary signals D0B to DnB of these data signals D0** to Dn and use other one-bit signal DY and a complementary signal DYB of the other one-bit signal DY.

Selection circuit portions selected by the signals (DXB, DX) are represented by selection circuit portions 20-($j$−1), 20-$j$, and 20-($j$+1) of a same configuration that uses four switch transistors as one group. A plurality of the selection circuit portions of the same configuration are included in a vertical direction of the page of FIG. 2. The selection circuit portion 20-$j$ will be herein described in detail.

The selection circuit portion 20-$j$ selects two of four reference voltage signals Vh, Vh+1, Vh+2, and Vh+3 using four switch transistors 21 to 24 that are controlled to be turned on and off by the signals (DXB, DX).

The switch transistor 21 is connected between a node N11 to which the reference voltage signal Vh is supplied and a node N12. The switch transistor 22 is connected between a node N13 to which the reference voltage signal Vh+1 is supplied and the node N12. The switch transistor 23 is connected between a node N14 to which the reference voltage signal Vh+2 is supplied and a node N15. The switch transistor 24 is connected between a node N16 to which the reference voltage signal Vh+3 is supplied and the node N15. The nodes N12 and N15 respectively supply the selected reference voltage signals to the selection circuit unit 40. The switch transistors 21 and 23 are commonly turned on and off. The switch transistors 22 and 24 are commonly turned on and off. The switch transistors 21 and 23 are complementarily turned on and off with the switch transistors 22 and 24. When the switch transistors 21 and 23 are turned on, the switch transistors 22 and 24 are turned off. When the switch transistors 21 and 23 are turned off, the switch transistors 22 and 24 are turned on.

The selection circuit portions 20-($j$−1) and 20-($j$+1) are also configured in a same manner. Each of the selection circuit portions 20-($j$−1) and 20-($j$+1) selects two of the four reference voltage signals responsive to the signals (DXB, DX) and supplies the selected signals to the selection circuit unit 40. The signal DX performs common on/off control over the switch transistors 22 and 24, and the signal DXB performs common on/off control over the switch transistors 21 and 23, for example. The signals DX and DXB may be interchanged. Then, the signal DXB may perform common control over the switch transistors 22 and 24, while the signal DX may perform common control over the switch transistors 21 and 23.

Selection circuit portions selected by the signals (DY, DYB) are represented by selection circuit portions 30-($j$−1), 30-$j$, and 30-($j$+1) of a same configuration that uses four switch transistors as one group. A plurality of selection circuit portions of the same configuration are included in a vertical direction of the page of FIG. 2. The selection circuit portion 30-$j$ will be described below in detail.

The selection circuit portion 30-$j$ selects two of four reference voltage signals Vi, Vi+1, Vi+2, and Vi+3 using four switch transistors 31 to 34 that are controlled to be turned on and off by the signals (DY, DYB). The switch transistor 31 is connected between a node N21 to which the reference voltage signal Vi is supplied and a node N22. The switch transistor 32 is connected between a node N23 to which the reference voltage signal Vi+1 is supplied and the node N22. The switch transistor 33 is connected between a node N24 to which the reference voltage signal Vi+2 is supplied and a node 25. The switch transistor 34 is connected between a node N26 to which the reference voltage signal Vi+3 is supplied and the node N25. The nodes N22 and N25 respectively supply the selected signals to the selection circuit unit 40.

The selection circuit portions 30-($j$−1) and 30-($j$+1) are also configured in a same manner. Each of the selection circuit portions 30-($j$−1) and 30-($j$+1) selects two of the four reference voltage signals and supplies the selected signals to the selection circuit unit 40. The signal DY performs common on/off control over the switch transistors 32 and 34, and the signal DYB performs common on/off control over the switch transistors 31 and 33, for example. The signals DY and DYB may be interchanged.

The selection circuit unit 40 receives the data signals (signals and their complementary signals) other than the signals (DXB, DX) and (DY, DYB) of the data signals DnB to D0B and Dn to D0, and selects one of the reference voltage signals selected by the signals (DXB, DX) and (DY, DYB) corresponding to the data signals excluding the data signals (DXB, DX) and (DY, DYB), and outputs the selected reference voltage signal to the terminal OUT.

Each of X and Y is one of integers from 0 to n, and X and Y may be the same. A specific example will be described later with reference to FIGS. 12 and 13.

Figure 3:
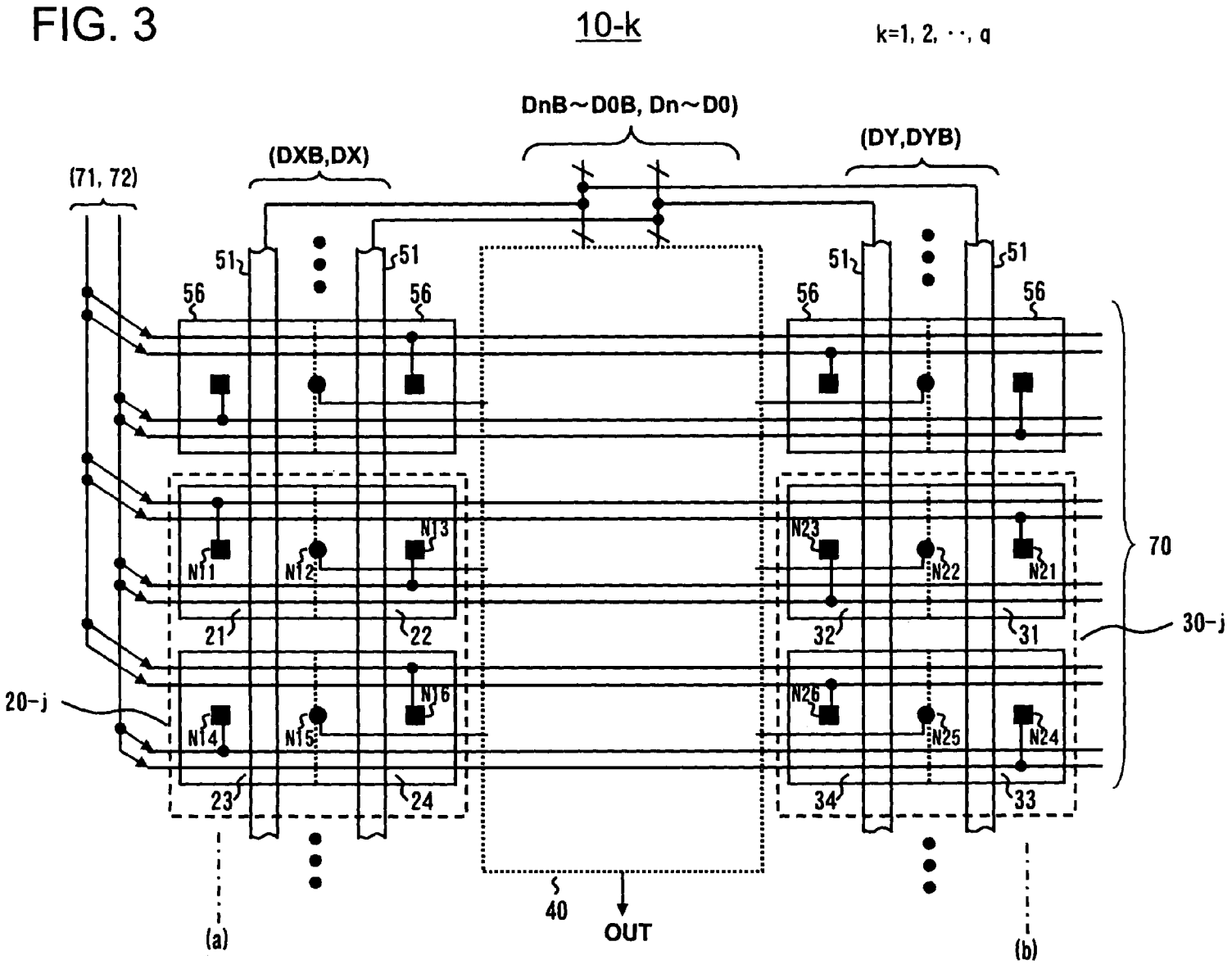
FIG. 3 is a diagram showing a configuration of a decoder in the example of the present invention.

FIG. 3 is a diagram showing a layout image of the decoder to which the present invention is applied. FIG. 3 corresponds to a circuit configuration of the decoder (**10-*k*) in FIG. 2. FIG. 3** shows the switch transistors that are controlled by the data signals (DXB, DX) and (DY, DYB) in the form of the layout image.

In each switch transistor, a gate layer 51 (gate electrode) is provided to extend over two impurity diffusion layers 56. Each of the impurity diffusion layers 56 with the gate layer 51 sandwiched therebetween is a drain region or a source region of the switch transistor. Each of a square symbol ■ and a circle symbol ● in FIG. 3 indicates a connection node of a drain region or a source region. The square symbol ■ indicates the node to which the reference signal is supplied, while the circle symbol ● indicates a node from which the reference voltage signal is output.

The example shown in FIG. 3 illustrates the layout image in which two of the switch transistors have output side nodes ● connected in common.

A horizontal direction on the page of FIG. 3 corresponds to a long-side direction of the data driver, while a vertical direction on the page of FIG. 3 corresponds to a short-side direction of the data driver.

By making one ends of the two switch transistors common (as the node ●), a pitch of the decoder (width of the decoder for one output) can be reduced.

The reference voltage signal lines 70 are arranged, extending in the long-side direction of the data driver. The reference voltage signal lines 70 include a first metal layer 72 and a second metal layer 72 that will be described later. Referring to FIG. 3, each signal line of the reference voltage signal lines 70 is shown as a straight line.

The selection circuit portion 20-*j* and the selection circuit portion 30-*j* will be described below as representatives of the selection circuit portions, as in FIG. 2.

The selection circuit portion 20-*j* includes the two switch transistors 21 and 22 that are adjacent in a row direction with the node N12 connected in common and the two switch transistors 23 and 24 that are adjacent in the row direction with the node N15 connected in common. The switch transistors 21 and 23 are adjacent to each other in a column direction as well, and the switch transistors 22 and 24 are adjacent to each other in the column direction as well.

The selection circuit portion 30-*j* includes the two switch transistors 31 and 32 that are adjacent in the row direction with the node N22 connected in common, and the two switch transistors 33 and 34 that are adjacent in the row direction with the node N25 connected in common. The switch transistors 31 and 33 are adjacent to each other in the column direction as well, and the switch transistors 32 and 34 are adjacent to each other in the column direction as well.

Eight reference voltage signal lines of the reference voltage signal lines 70, which are constituted from four reference voltage signal lines on the first metal layer 71 and four reference voltage signal lines on the second metal layer 72 are provided in common to the selection circuit portions 20-*j* and 30-*j*, and are wired immediately above or closest to layout placements of the switch transistors 21 to 24 and 31 to 34.

Referring to FIG. 3, to the switch transistors 21 to 24 in a 2×2 matrix of the selection circuit portion 20-*j*, reference voltage signals are respectively supplied from two reference voltage signal lines on the first metal layer 71 and two reference voltage signal lines on the second metal layer of the eight reference voltage signal lines. The signals are supplied from the metal layers that are different between the adjacent transistors. Such a configuration constitutes one of features of the present invention.

Specifically, when the node N11 of the switch transistor 21 and the node N16 of the switch transistor 24 are connected to one of the metal layers 71 and 72, the node N13 of the switch transistor 22 and the node N14 of the switch transistor 23 is connected to the other of the metal layers 71 and 72.

To the switch transistors 31 to 34 in a 2×2 matrix of the selection circuit portion 30-*j*, reference voltage signals are respectively supplied from remaining two reference voltage signal lines on the first metal layer 71 and remaining two reference voltage signal lines on the second metal layer 72 of the eight reference voltage signal lines. The signals are supplied to the adjacent transistors from the metal layers that are different. Such a configuration constitutes one of features of the present invention. Specifically, when the node N21 of the switch transistor 31 and the node N26 of the switch transistor 34 are connected to one of the metal layers 71 and 72, the node N23 of the switch transistor 32 and the node N24 of the switch transistor 33 is connected to the other of the metal layers 71 and 72.

Referring to FIG. 3, a straight line that passes through a node group including the nodes N11 and N14 is set to a boundary line (a) between the decoder 10-*k* and an adjacent decoder (such as the decoder 10-(*k*−1)), and a straight line that passes through a node group including the nodes N21 and N24 is set to a boundary line (b) between the decoder 10-*k* and an adjacent decoder (such as the decoder 10-(*k*+1)). Then, the decoders are mirror arranged (arranged in mirror symmetry) with respect to each of the boundary line (a) and the boundary line (b) as shown in FIG. 1. Then, each node that passes through the boundary is shared between the adjacent decoders. Thus, the pitch of the decoder (width of the decoder for one output) can be reduced.

The four transistors that are adjacent in the row and column directions of the selection circuit portion 20-*j* or the selection circuit portion 30-*j* may be shifted in arrangement by some degree, as necessary.

Further, the selection circuit portion 20-*j* and the selection circuit portion 30-*j* that sandwich the selection circuit unit 40 may be shifted by some degree if the selection circuit portions 20-*j* and 30-*j* can share the eight reference voltage signal lines. The selection circuit unit 40 has the same configuration as in FIG. 2. Thus, description of the selection circuit unit 40 will be omitted.

Figure 15B:
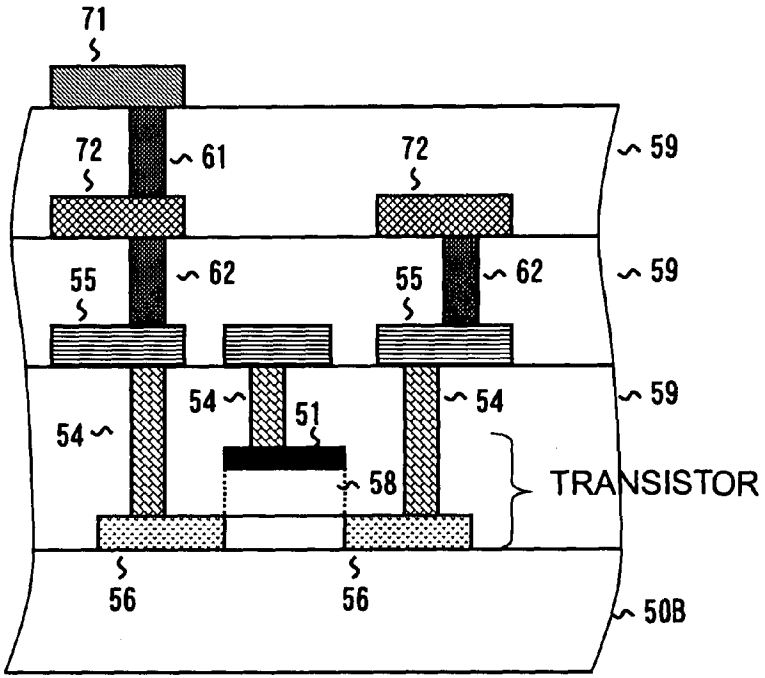
FIGS. 15A and 15B are diagrams each showing a sectional configuration of a semiconductor device.
Figure 15A:
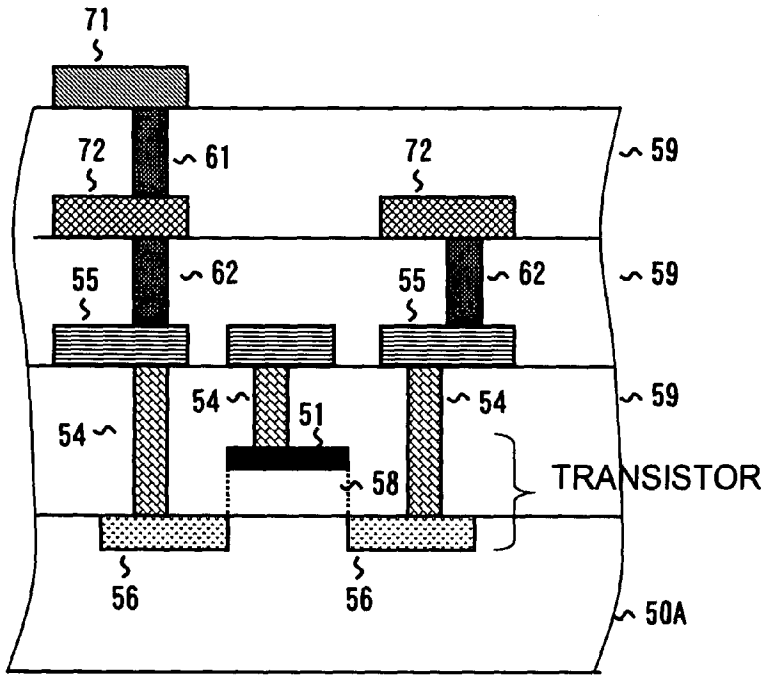

A configuration example of an integrated circuit device according to the exemplary embodiment of the present invention will be described. FIGS. 15A and 15B are diagrams each showing sectional structures of a transistor and lines in the exemplary embodiment of the present invention. FIG. 15A schematically shows a configuration in which the transistor is formed on a surface of a silicon substrate. FIG. 15B schematically shows a configuration (SOI: Silicon On Insulator) in which the transistor is formed on an insulating substrate. As shown in FIG. 15A, the transistor includes source and drain regions 56 formed in a impurity diffusion layer on a surface of a substrate 50A and a gate electrode 51 provided through a gate insulating layer 58 above a channel region between the source and drain regions 56. At least the metal layer 71, the metal layer 72, and a metal layer 55 that perform connection between transistors and other elements are included. An insulating film (inter-layer insulating film) 59 is formed between the respective layers. The gate 51, source (impurity diffusion layer) 56, and drain (impurity diffusion layer) 56 of the transistor are connected to the metal layer 55 via contacts 54 (a contact being hereinafter also abbreviated as a "CT"). The metal layer 55 is connected to the overlying second metal layer 72 via through-holes 62 (a through-hole being hereinafter also abbreviated as a "TH"). Further, the metal layer 72 is connected to the overlying metal layer 71 via a TH61. The TH61 may also be formed immediately above the TH62 through the metal layer 72. The TH62 may also be formed immediately above the CT 54 through the metal layer 55.

Generally, in the integrated circuit device, aluminum or aluminum alloy that can be easily processed and is inexpensive is employed as an interconnect material (AL) for the metal layers 55, 71, and 72. A metal material other than aluminum (such as copper (Cu)) may be used as the interconnect material. FIG. 15 shows an example of a three-layer configuration of the metal layers 55, 72, and 71. Another metal layer may be further provided above the metal layer 71. The metal layer on an uppermost layer may also be connected to an outside via a bump at a PAD and may receive signals supplied from the outside or output signals to the outside. As the substrate 50A, a substrate formed of single-crystal silicon is generally employed. An insulating substrate 50B formed of glass or the like may be employed, as shown in FIG. 15B. The transistor formed on the insulating substrate 50B is generally referred to as a thin-film transistor (TFT). The transistor constituted from source and drain regions 56 and a gate electrode 51 provided above a channel region between the source and drain regions 56 through a gate insulating layer 58 is formed. At least a metal layer 71, a metal layer 72, and a metal layer 55 that perform connection between transistors and other elements are included. An insulating film (inter-layer insulating film) 59 is formed between the respective layers.

Figure 4A:
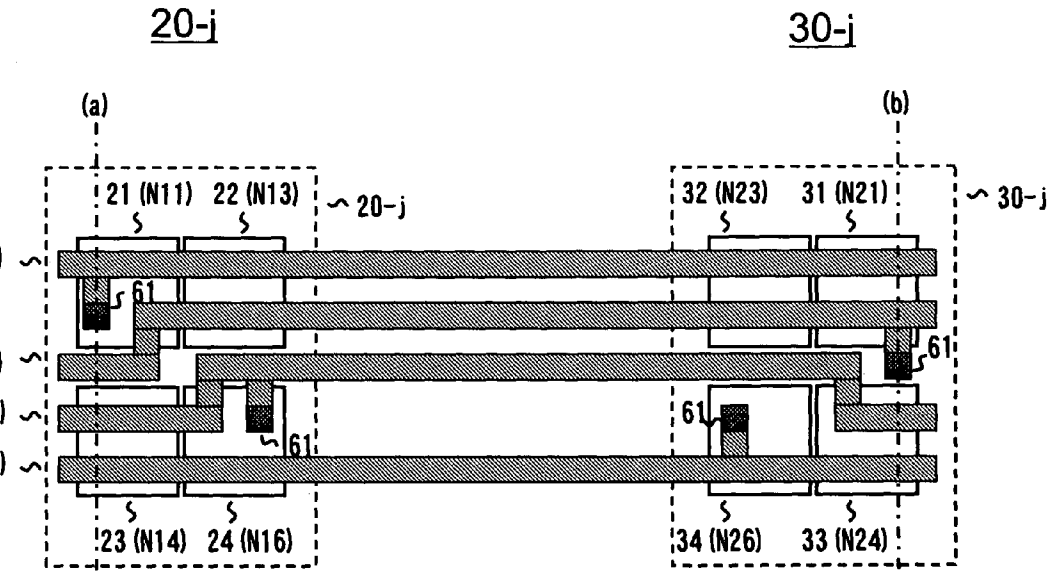
FIGS. 4A and 4B are diagrams each showing a layout configuration of a metal layer in the example of the present invention.
Figure 4B:
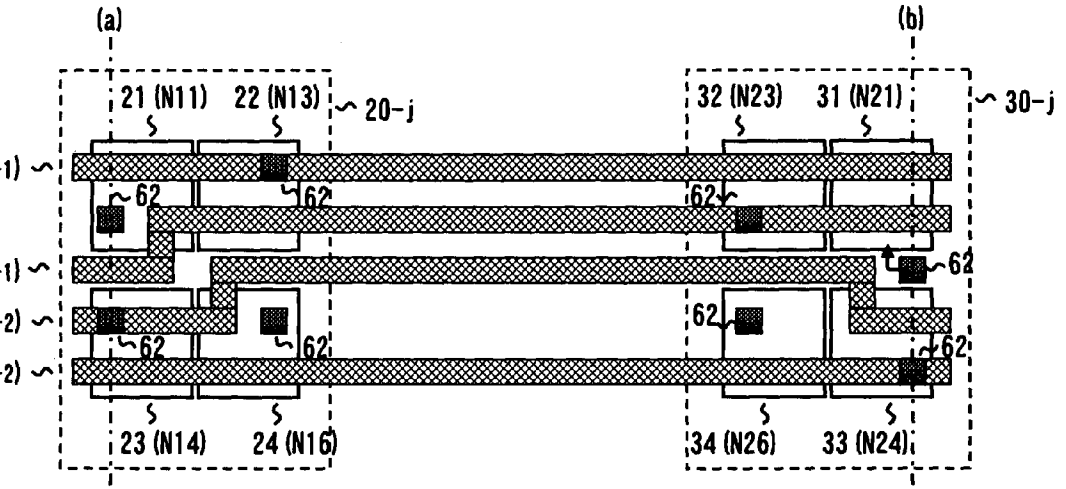

Each of FIGS. 4A and 4B shows a high-density interconnect layout in the exemplary embodiment of the present invention.

FIGS. 4A and 4B shows a layout pattern of eight reference voltage signal lines that supply reference voltage signals to the eight switch transistors 21 to 24, 31 to 34 of the selection circuit portions 20-*j* and 30-*j* of the decoder 10-*k* in FIG. 3.

FIG. 4A shows four reference voltage signal lines 71-1 to 71-4 out of the eight reference voltage signal lines formed on the metal layer 71. FIG. 4B shows four reference voltage signal lines 72-1 to 72-4 out of the eight reference voltage signal lines formed on the metal layer 72.

For facilitating the description, structures in FIGS. 4A and 4B are respectively set to be the same as the structures in FIGS. 15A and 15B. For facilitating understanding of each switch transistor, the switch transistor is simply shown as each of four rectangles in the 2×2 matrix for each selection circuit portion.

In FIG. 4A, the THs 61 connect the metal layer 71 and the underlying metal layer 72.

In FIG. 4B, the THs 62 connect the metal layer 72 and the underlying metal layer 55. Description of the metal layer 55 and the contacts (CTs) that connect the metal layer 55 and nodes (sources and drains) of the switch transistors is omitted in order to avoid complexity of the drawings. However, the THs 62 shown in FIG. 4B are set to be connected to the nodes of the nearest transistors. When a plurality of the nearest switch transistors is present for the TH 62, an arrow is used to indicate connection from the TH 62 to the switch transistor of a connecting destination (as in connection from the TH 62 to the node N21 of the switch transistor 31 in FIG. 4B, for example). An example is shown where the TH61 connected to the TH 62 is formed immediately above the TH 62 through the metal layer 72. Placements of the TH 61 and the TH 62 may be of course shifted.

Description of the selection circuit unit 40 in FIG. 3 is omitted in each of FIGS. 4A and 4B. Straight lines designated respectively by reference characters (a) and (b) in FIGS. 4A and 4B indicate boundaries between the adjacent decoders described with reference to FIG. 3.

As shown in FIGS. 4A and 4B, each node that receives voltage supply for a corresponding one of the four switch transistors in the 2×2 matrix in each of the selection circuit portions 20-*j* and 30-*j* is connected to a corresponding one of two reference voltage signal lines on the metal layer 71 and two reference voltage signal lines on the metal layer 72. The nodes of the adjacent transistors in the 2×2 matrix are connected to the metal layers that are different.

Specifically, referring to FIG. 4A, the reference voltage signal line 71-1 of the four reference voltage signal lines 71-1 to 71-4 formed by the metal layer 71 supplies the voltage signal Vh, and is connected to the node N11 of the switch transistor 21 of the selection circuit portion 20-*j* via the THs 61 and 62. The THs 61 and 62 may be arranged on the boundary line (a) between the decoder 10-*k* and the adjacent decoder (not shown) on the left side of the page of FIG. 4A or in the vicinity of the boundary line (a). The THs 61 and 62, together with the node N11 of the switch transistor 21, may be shared between the decoder 10-*k* and the adjacent decoder.

The reference voltage signal line 71-2 adjacent to the reference voltage signal line 71-1 supplies the voltage signal Vi, and is connected to the node N21 of the switch transistor 31 of the selection circuit portion 30-*j* via the THs 61 and 62. The THs 61 and 62 may be arranged on the boundary line (b) between the decoder 10-*k* and the adjacent decoder (not shown) on the right side of the page of FIG. 4A or in the vicinity of the boundary line (b). Then, the THs 61 and 62, together with the node N21 of the switch transistor 31, may be shared between the decoder 10-*k* and the adjacent decoder.

The reference voltage signal line 71-3 adjacent to the reference voltage signal line 71-2 supplies the voltage signal Vh+3, and is connected to the node N16 of the switch transistor 24 of the selection circuit portion 20-*j* via the THs 61 and 62.

The reference voltage signal line 71-4 adjacent to the reference voltage signal line 71-3 supplies the voltage signal Vi+3, and is connected to the node N26 of the switch transistor 34 of the selection circuit portion 30-*j* via the THs 61 and 62.

As shown FIG. 4B, the reference voltage signal line 72-1 of the four reference voltage signal lines 72-1 to 72-4 formed by the metal layer 72 supplies the voltage signal Vh+1, and is connected to the node N13 of the switch transistor 22 of the selection circuit portion 20-*j* via the TH 62.

The reference voltage signal line 72-2 adjacent to the reference voltage signal line 72-1 supplies the voltage signal Vi+1, and is connected to the node N23 of the switch transistor 32 of the selection circuit portion 30-*j* via the TH 62.

The reference voltage signal line 72-3 adjacent to the reference voltage signal line 72-2 supplies the voltage signal Vh+2, and is connected to the node N14 of the switch transistor 23 of the selection circuit portion 20-*j* via the TH 62. The TH 62 may be arranged on the boundary line (a) between the decoder 10-*k* and the adjacent decoder (not shown) on the left side of the page of FIG. 4B or in the vicinity of the boundary line (a). Then, the TH 62, together with the node N14 of the switch transistor 23, may be shared between the decoder 10-*k* and the adjacent decoder.

The reference voltage signal line 72-4 adjacent to the reference voltage signal line 72-3 supplies the voltage signal Vi+2, and is connected to the node N24 of the switch transistor 33 of the selection circuit portion 30-*j* via the TH 62. The TH 62 may be arranged on the boundary line (b) between the decoder 10-*k* and the adjacent decoder (not shown) on the right side of the page of FIG. 4B or in the vicinity of the boundary line (b). Then, the TH 62, together with the node N24 of the switch transistor 33, may be shared between the decoder 10-*k* and the adjacent decoder.

In the example shown in FIGS. 4A and 4B, the switch transistors 21 and 24 of the selection circuit portion 20-*j* are connected to the metal layer 71. The switch transistors 22 and 23 are connected to the metal layer 72.

The switch transistors 31 and 34 of the selection circuit portion 30-*j* are connected to the metal layer 71. The switch transistors 32 and 33 are connected to the metal layer 72.

Referring to FIGS. 4A and 4B, each of the THs 61 and 62 that connect the metal layer 71 and the transistors must be separated from a corresponding one of the reference voltage signal lines 72-1 to 72-4 of the metal layer 72 by a predefined separation distance.

Each of the THs 62 that connect the metal layer 72 and the transistors may be formed immediately under a corresponding one of the lines of the metal layer 72.

The drain nodes of the adjacent transistors are connected to the metal interconnect layers of the different layers through the contacts and the through-holes, in this exemplary embodiment.

Referring to FIG. 4A, the reference voltage signal line 71-1 on the metal layer 71 is linearly extended above regions of the switch transistors 21 and 22 of the selection circuit portion 20-*j* and regions of the switch transistors 32 and 31 of the selection circuit portion 30-*j* in the row direction (row direction of placements of the transistors 21 to 24 and the transistors 31 to 34 in the 2×2 matrices). Though not limited thereto, the TH 61 for being connected to the node N11 of the switch transistor 21 in the selection circuit portion 20-*j* is placed on the side of the reference voltage signal line 71-2 adjacent to the reference voltage signal line 71-1 on the metal layer 71. The reference voltage signal line 71-1 on the metal layer 71 includes a pattern projected in a direction perpendicular to the extended direction of the reference voltage signal line 71-1, as a connection portion for being connected to the TH 61.

The reference voltage signal line 71-2 on the metal layer 71 is extended above a location between the region of the switch transistor 21 and a region of the switch transistor 23. It is noted that the location of the reference voltage signal line 71-2 is not limited between the regions of the switch transistors 21 and 23 and that the reference voltage signal line 71-2 may partially overlap with one of the regions of the switch transistors 21 and 23. After the reference voltage signal line 71-2 passes through a location corresponding to the TH61 connected to the node N11 of the switch transistor 21 and further extended, the reference voltage signal line 71-2 is bent toward the reference voltage signal line 71-1 and then is extended. The reference voltage signal line 71-2 is further bent at a location corresponding to the TH 61 and is linearly extended in parallel with the reference voltage signal line 71-1 on the metal layer 71. The reference voltage signal line 71-2 is linearly arranged above the regions of the switch transistors 32 and 31 of the selection circuit portion 30-*j* in the row direction. The TH 61 for being connected to the node N21 of the switch transistor 31 in the selection circuit portion 30-*j* is placed on the side of the reference voltage signal line 71-3 from the reference voltage signal line 71-2 on the metal layer 71. The reference voltage signal line 71-2 on the metal layer 71 includes a pattern projected in a direction perpendicular to the extended direction of the reference voltage signal line 71-2, as a connection portion for being connected to the TH 61.

The reference voltage signal line 71-3 on the metal layer 71 has a pattern as follows. The reference voltage signal line 71-3 on the metal layer 71 goes straight above the region of the switch transistor 23 in the selection circuit portion 20-*j*. Then, before the reference voltage signal line 71-3 reaches the TH61 connected to the node N16 of the switch transistor 24, or after the reference voltage signal line 71-3 passes through over the TH61, the reference voltage signal line 71-3 is bent toward the reference voltage signal line 71-2 and is extended. The reference voltage signal line 71-3 is further bent and is then linearly extended in parallel with the reference voltage signal lines 71-1 and 71-2 on the metal layer 71. The reference voltage signal line 71-3 in the selection circuit portion 30-*j* is bent toward the reference voltage signal line 71-4 in front of the TH61 of the reference voltage signal line 71-2 on the metal layer 71 and is extended by a predetermined distance. The reference voltage signal line 71-3 is further bent and is then extended in parallel with the reference voltage signal line 71-4.

The reference voltage signal line 71-4 on the metal layer 71 is linearly arranged above the region of the switch transistor 23 and a region of the switch transistor 24 in the selection circuit portion 20-*j* and regions of the switch transistors 32 and 31 in the selection circuit portion 30-*j* in the row direction. Though not limited thereto, the TH 61 for being connected to the node N26 of the switch transistor 34 in the selection circuit portion 20-*j* is placed on the side of the reference voltage signal line 71-3 from the reference voltage signal line 71-4 on the metal layer 71. The reference voltage signal line 71-4 on the metal layer 71 includes a pattern projected in a direction perpendicular to the extended direction of the reference voltage signal line 71-4, as a connection portion for being connected to the TH 61.

Referring to FIG. 4B, the reference voltage signal line 72-1 on the metal layer 72 is linearly arranged above the regions of the switch transistors 21 and 22 in the selection circuit portion 20-*j* and the regions of the switch transistors 32 and 31 in the selection circuit portion 30-*j* in the row direction (row direction of placements of the transistors 21 to 24 and the transistors 31 to 34 in the 2×2 matrices). The TH 62 for being connected to the node N13 of the switch transistor 22 is provided for the reference voltage signal line 72-1 on the metal layer 72 in the selection circuit portion 20-*j*.

The reference voltage signal line 72-2 on the metal layer 72 is extended above a location between the regions of the switch transistors 21 and 23. The reference voltage signal line 72-2 is extended from a location that sandwiches the TH 62 connected to the node N11 of the switch transistor 21 with the reference voltage signal line 72-1 on the metal layer 72. Then, after the reference voltage signal line 72-2 passes through the TH62 connected to the node N11 and is further extended by a predetermined distance, the reference voltage signal line 72-2 is bent toward the reference voltage signal line 72-1 on the metal layer 72 and is then linearly extended in parallel with the reference voltage signal line 72-1 on the metal layer 72. The reference voltage signal line 72-2 is linearly arranged above the regions of the switch transistors 32 and 31 in the selection circuit portion 30-*j* in the row direction. The TH 61 for being connected to the node N23 of the switch transistor 32 in the selection circuit portion 30-*j* is provided for the reference voltage signal line 72-2 on the metal layer 72.

The reference voltage signal line 72-3 on the metal layer 72 has a pattern as follows. The reference voltage signal line 72-3 on the metal layer 72 goes straight above the region of the switch transistor 23. Then, before the reference voltage signal line 72-3 reaches the TH62 connected to the node N16 of the switch transistor 24, the reference voltage signal line 72-3 is bent toward the reference voltage signal line 71-2 on the metal layer 72 and is extended. The reference voltage signal line 72-3 is further bent and is then linearly extended in parallel with the reference voltage signal lines 72-1 and 72-2 on the metal layer 72. In the selection circuit portion 30-*j*, the reference voltage signal line 72-3 passes through the TH 62 connected to the node N26 of the switch transistor 34 and is bent toward the reference voltage signal line 72-4 before the reference voltage signal line 72-3 reaches the TH 62 connected to the node N21 of the switch transistor 31. The reference voltage signal line 72-3 is further bent and is then extended in parallel with the reference voltage signal line 72-4. The TH 62 connected to the node N26 of the switch transistor 34 is arranged between the reference voltage signal lines 72-3 and 72-4.

The reference voltage signal line 72-4 on the metal layer 72 is linearly arranged in the row direction above the regions of the switch transistors 23 and 24 in the selection circuit portion 20-*j* and the regions of the switch transistors 34 and 33 in the selection circuit portion 30-*j*. Though not limited thereto, the TH62 for being connected to the node N24 of the switch transistor 33 in the selection circuit portion 30-*j* is provided for the reference voltage signal line 72-4 on the metal layer 72.

In the example shown in FIGS. 4A and 4B, a layout pattern of the reference voltage signal lines 71-1 to 71-4 on the metal layer 71 in FIG. 4A overlaps with a layout pattern of the reference voltage signal lines 72-1 to 72-4 on the underlying metal layer 72 in FIG. 4B. The interconnect layout pattern on the metal layer 72 in FIG. 4B is such that one line is held between the TH 62 connected to the node N11 and the TH 62 connected to the node 24. The THs 61 and 62 connected to the respective nodes of the switch transistors 21, 23, 31, and 33 are arranged on the boundary line (a) between the decoder 10-*k* and a decoder (not shown) on the left side of the switch transistors 21 and 23 or the boundary line (b) between the decoder 10-*k* and an decoder (not shown) on the right side of the switch transistors 31 and 33. The THs 61 and 62, together with the respective nodes, can be shared with the adjacent decoders (not shown). As a result, the layout for connection from the THs 62 through the metal layer 55 to the respective switch transistors (refer to FIG. 15) is facilitated.

With respect to layout (interconnect pattern) of the reference voltage signal lines on the metal layers 71 and 72, the area of five reference voltage signal lines should be ensured for the four reference voltage signal lines owing to the above mentioned layout. That is, high-density interconnect can be implemented. The layout where a distance between the adjacent transistors is reduced can be implemented. To take an example, the configuration in which the node N12 (in FIG. 3) is shared between the switch transistors 21 and 22 of the selection circuit portion 20-*j* can be implemented. A separation distance between the switch transistors 21 and 23 can also be reduced. Accordingly, this exemplary embodiment can achieve area saving.

The interconnect patterns of the first and second metal layers 71 and 72 in FIGS. 4A and 4B are arranged to overlap with each other, except connection portions with the through-holes. Generally, the reference voltage signal is used to provide a constant voltage signal. A larger parasitic capacitance between the reference voltage signal lines increases signal stability. Thus, it is preferable that the metal layers 71 and 72 have large overlapping areas, and a separation distance between the metal layers 71 and 72 be as small as possible. In the vicinity of the connection portions with the through-holes, the interconnect patterns on the metal layers 71 and 72 may be displaced in some degree.

In the interconnect patterns on the metal layers 71 and 72 on FIGS. 4A and 4B, one signal line is formed of an identical layer alone, and bent portions of the signal line is set to four at maximum. Even if the signal lines extend over a plurality of decoders, an increase in interconnect resistance can be minimized. In case one signal line is formed of a plurality of metal layers, the interconnect resistance increases due to addition of through-hole resistances at connection portions. In case the number of bent portions is large, the interconnect resistance increases.

In this exemplary embodiment, the signal line is formed of the identical layer alone, and the number of bent portions is small. Thus, low-resistance interconnect is achieved. Referring to FIGS. 4A and 4B, an example of bending of the signal line by 90 degrees is illustrated. When the signal line is bent by 45 degrees, however, further low-resistance interconnect can be achieved.

Figure 16A:
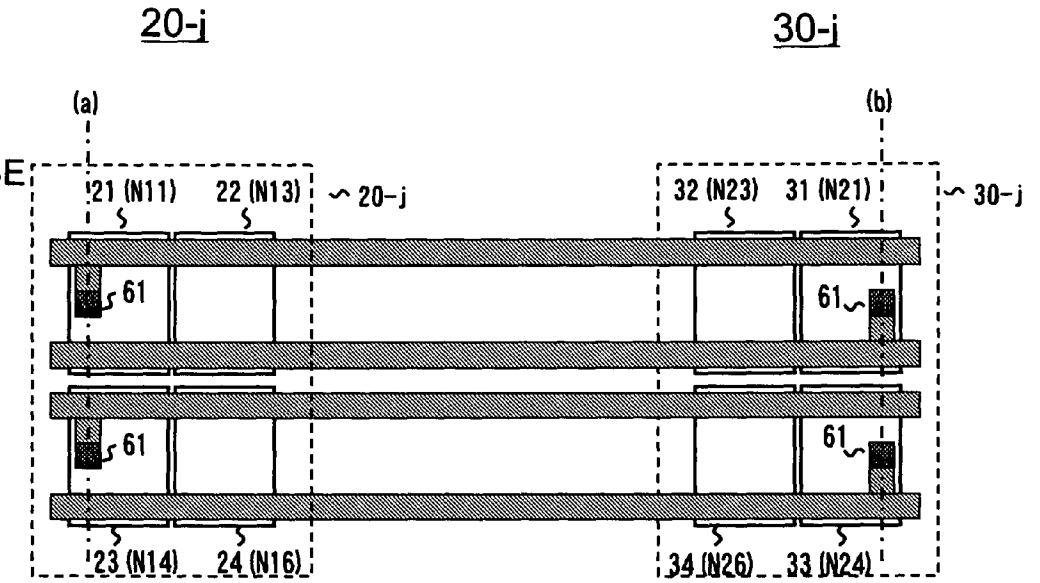
FIGS. 16A and 16B are diagrams each showing a layout configuration of a metal layer in a comparative example.
Figure 16B:
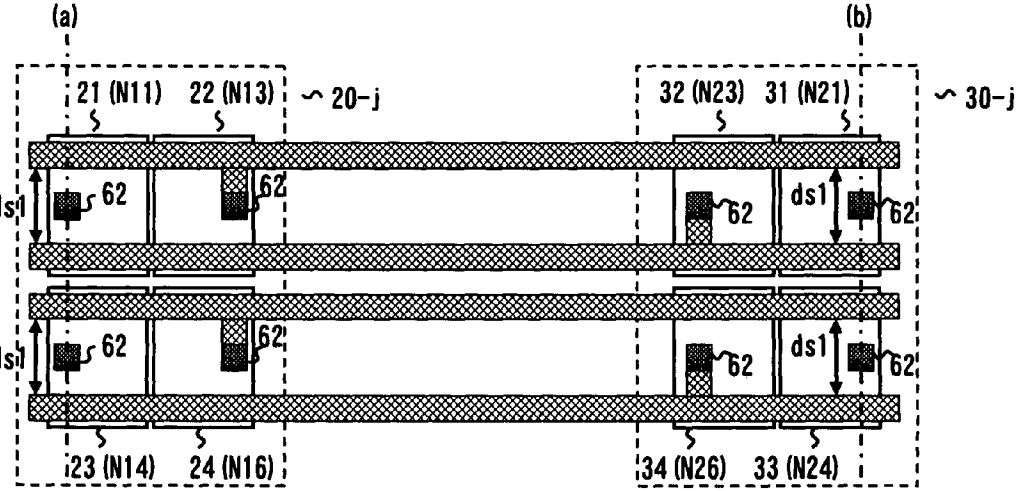
Figure 17:
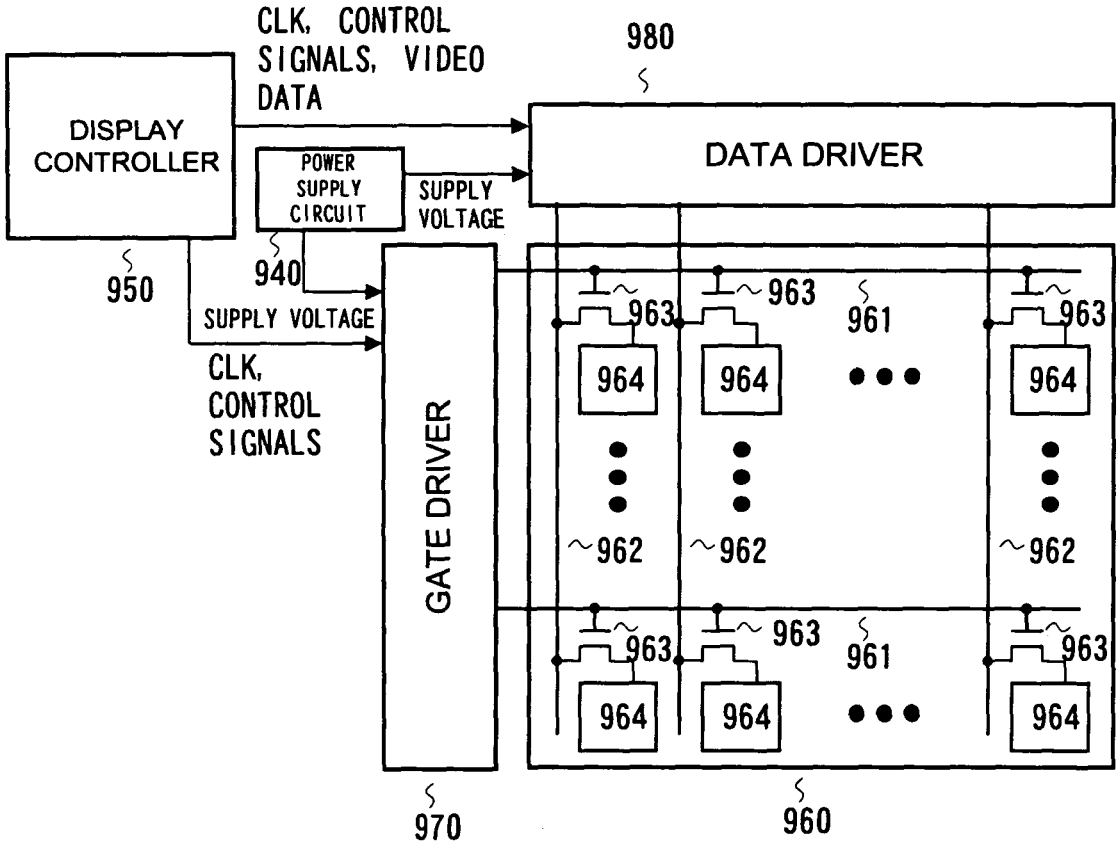
FIG. 17 RELATED ART
FIG. 17 is a diagram showing a typical configuration of a display apparatus.
Figure 18:
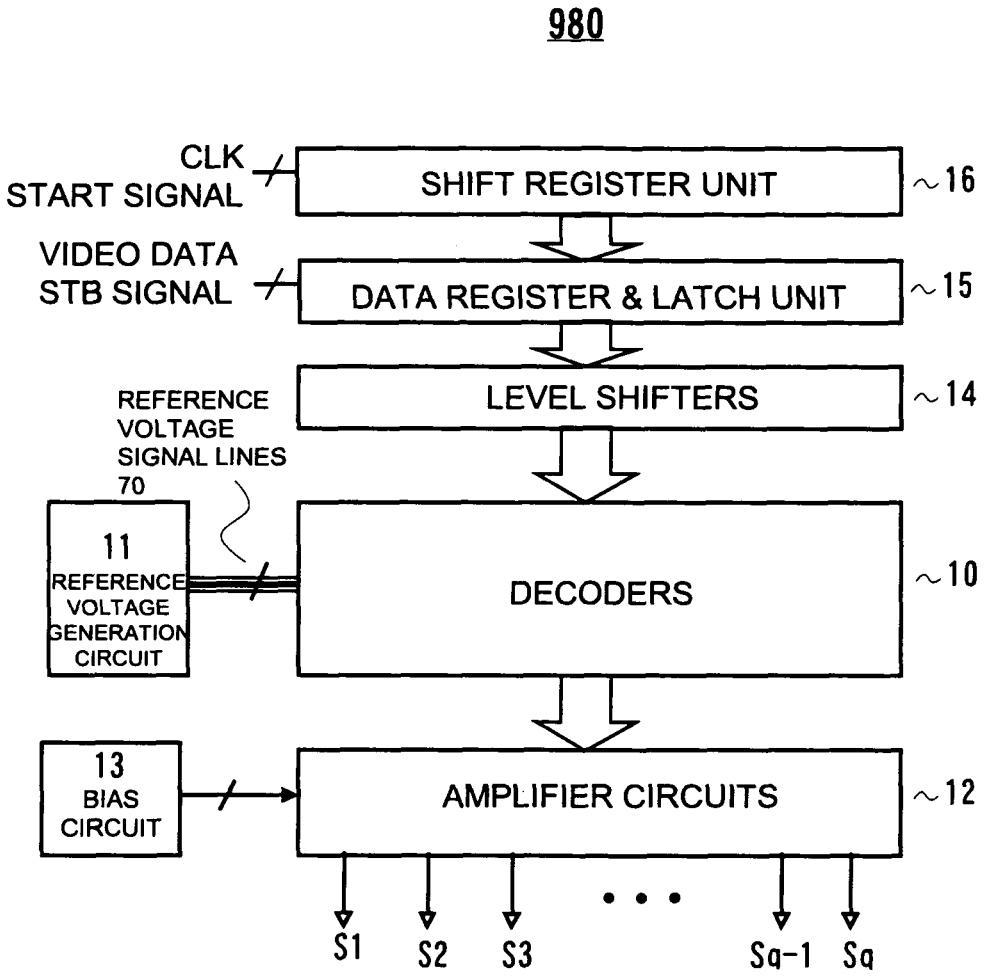
FIG. 18 RELATED ART
FIG. 18 is a diagram showing a typical configuration example of a data driver.

FIGS. 16A and 16B show a layout example of a comparative example. In order to clarify an effect of the layout of the reference voltage signal lines of the present invention, the layout example of reference voltage signal lines which is different from that in the present invention will be described with reference to FIGS. 16A and 16B. Each of FIGS. 16A and 16B shows the layout in which each node is connected to a metal layer which is identical between transistors that are adjacent in a column direction. Each node receives voltage supply for each of four switch transistors in a 2×2 matrix in each of selection circuit portions 20-*j* and 30-*j*. Like FIGS. 4A and 4B, FIGS. 16A and 16B show a case where THs 61 and 62 connected to respective nodes of switch transistors 21, 23, 31, and 33 are arranged on one of boundaries (a) and (b) with adjacent decoders (not shown) on the left and right sides of the page of FIGS. 16A and 16B.

Referring to FIGS. 16A and 16B, the switch transistors 21 and 23 in the selection circuit portion 20-*j* are both connected to a metal layer 71, and the THs 61 and 62 must be separated from reference voltage signal lines on a metal layer 72 by a predefined separation distance ds1. The separation distance ds1 is the sum of the width of the TH62 and two separation distances each between the metal layer 72 and the TH62 that connects the metal layer 71 to the switch transistor.

The same holds true for the switch transistors 31 and 33 in the selection circuit portion 30-*j* as well. The THs 61 and 62 must be separated from the reference voltage signal lines on the metal layer 72 by the predefined separation distance ds1. Therefore, the signal densities of the reference voltage signal lines on the metal layer 72 in the vicinity of the switch transistors 21 and 23 and in the vicinity of the switch transistors 31 and 33 in a column direction are reduced more than in FIGS. 4A and 4B, because the THs 61 and 62 are successively separated from the reference voltage signal lines on the metal layer 72 by the separation distance ds1. Specifically, the area for six signal lines is necessary for the four signal lines. Accordingly, a separation distance between the switch transistors 31 and 33 cannot be reduced as well as a separation distance between the switch transistors 21 and 23 and the area of the decoder of the comparative example increases.

FIGS. 5 to 11 are diagrams showing variation examples of the example shown in FIG. 4. Referring to FIGS. 5 to 11, each node that receives voltage supply for a corresponding one of the four switch transistors in the 2×2 matrix of each of the selection circuit portions 20-*j* and 30-*j* is connected to a corresponding one of two reference voltage signal lines on the metal layer 71 and two reference voltage signal lines on the metal layer 72, and the metal layer that is different between the adjacent transistors. Each of FIGS. 5 to 11 shows an example where the THs 61 and 62 connected to the respective nodes of the switch transistors 21, 23, 31, and 33 are arranged on one of the boundary line (a) and the boundary line (b) with the adjacent decoders on the left and right sides of the page of the drawing. Each variation can achieve a similar effect to that in FIGS. 4A and 4B.

Figure 5A:
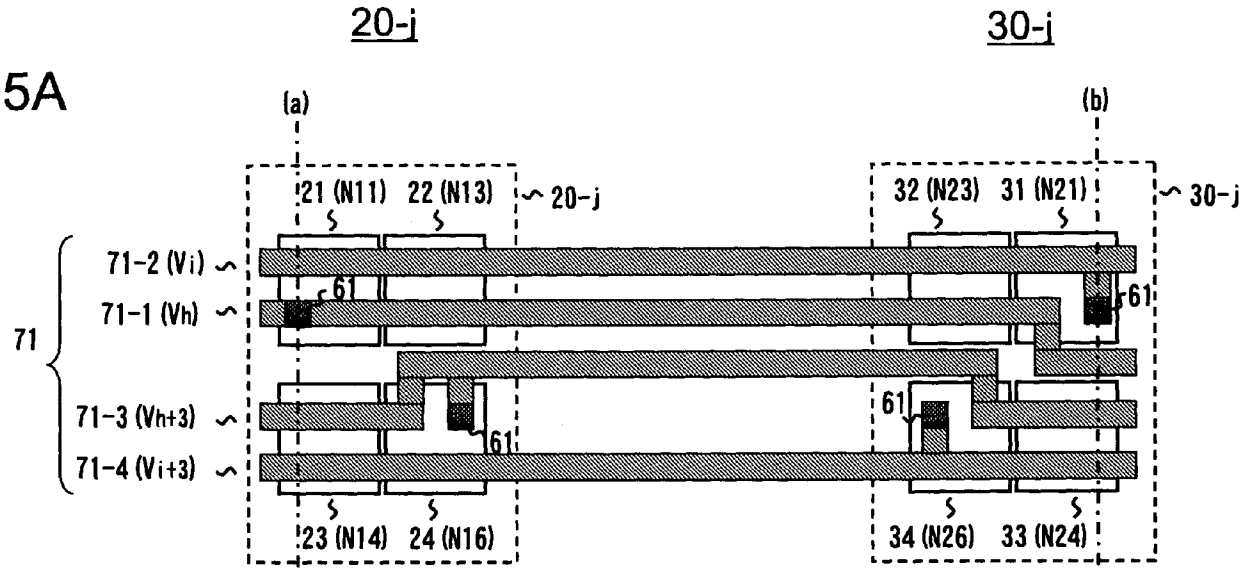
FIGS. 5A and 5B are diagrams each showing another layout configuration of the metal layer in the example of the present invention.
Figure 5B:
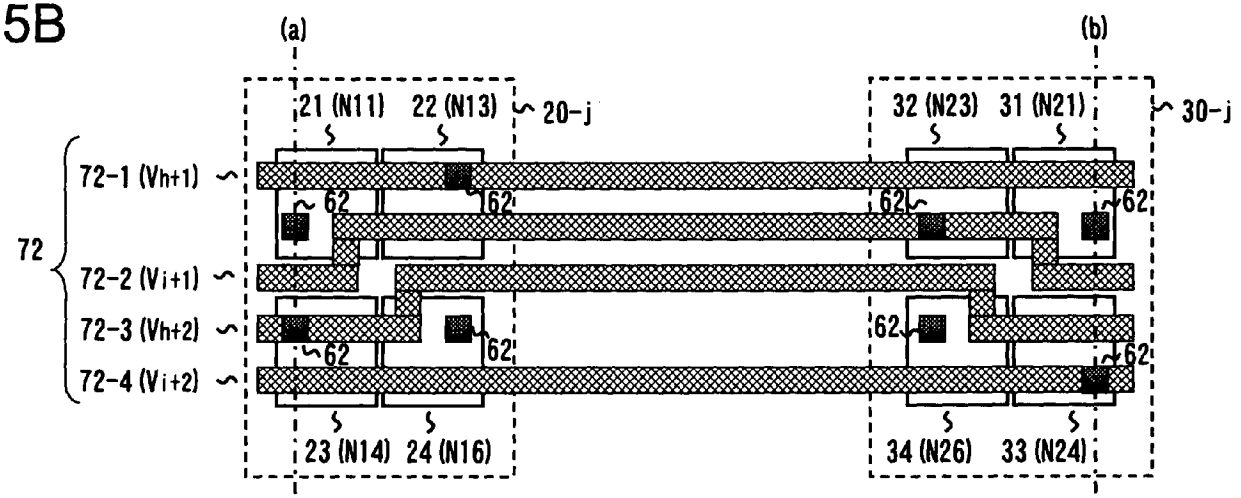

FIG. 5 is a diagram showing a first variation example of the example in FIGS. 4A and 4B. FIGS. 5A and 5B show interconnect patterns in which the order of the reference voltage signal lines 71-1 and 71-2 on the metal layer 71 in FIGS. 4A and 4B is interchanged. With this arrangement, placements of the THs 61 and 62 that connect the reference voltage signal line 71-1 and the switch transistor 31 in the selection circuit portion 30-*j* are a little changed. The reference voltage signal lines 71-1 and 71-2 on the metal layer 71 are extended above the switch transistor 21 of the selection circuit portion 20-*j* to the region of the switch transistor 31 in the selection circuit portion 30-*j*. The reference voltage signal line 71-1 is once bent toward the reference voltage signal line 71-3 before the reference voltage signal line 71-1 reaches the TH61 for the reference voltage signal line 71-2. Then, the reference voltage signal line 71-1 is extended in parallel with the reference voltage signal line 71-2 again. The TH61 for being connected to the node N11 of the switch transistor 21 is provided for the reference voltage signal line 71-1 on the metal layer 71. The order of the reference voltage signal lines 71-3 and 71-4 and the order of the reference voltage signal lines 72-1 to 72-4 on the metal layer 72 is the same as those in FIGS. 4A and 4B. Arrangement of the respective transistors in the selection circuit portions 20-*j* and 30-*j*, connection relationships between each transistor and each of the reference voltage signals 71-1 to 71-4 and 72-1 to 72-4, and a relationship of a reference voltage signal supplied from each reference voltage signal line are also the same as those in FIGS. 4A and 4B.

Even in the interconnect patterns of the present invention in which the order of the reference voltage signal lines 71-1 and 71-2 on the metal layer 71 is interchanged, the similar effect to that which can be implemented by the layouts of FIGS. 4A and 4B. That is, in the layouts (interconnect patterns) of the reference voltage signal lines on each of the metal layers 71 and 72, only the area of five reference voltage signal lines is occupied for the four reference voltage signal lines. High density interconnect can be thereby implemented. Then, at the same time, the layout, in which a distance between the adjacent transistors is reduced, can also be implemented. In the interconnect patterns on the metal layers 71 and 72, one signal line is formed of the identical layer alone. Further, the number of bent portions of the signal line is four at the maximum. Thus, even if the signal lines extend over a plurality of decoders, an increase in interconnect resistance can be suppressed to a minimum.

Figure 6A:
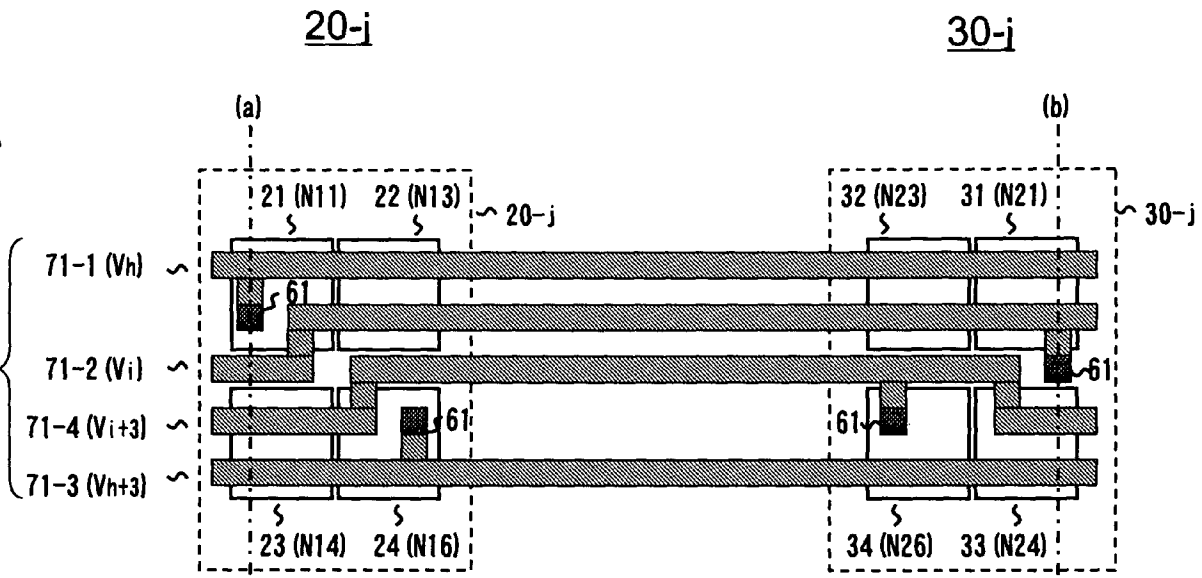
FIGS. 6A and 6B are diagrams each showing another layout configuration of the metal layer in the example of the present invention.
Figure 6B:
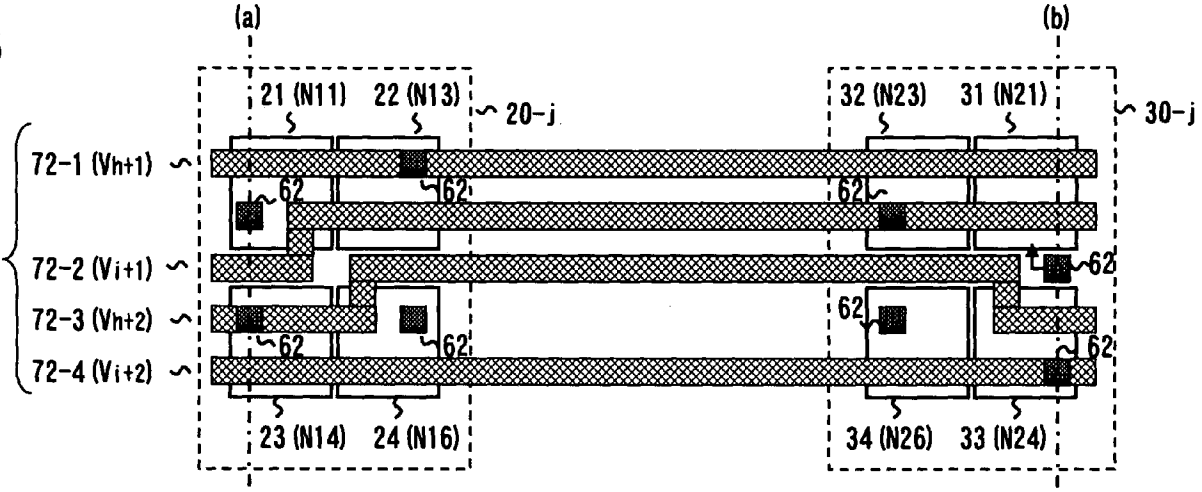

FIGS. 6A and 6B shows a second variation example of the example in FIGS. 4A and 4B. FIGS. 6A and 6B show interconnect patterns in which only the order of the reference voltage signal lines 71-3 and 71-4 on the metal layer 71 in FIGS. 4A and 4B is interchanged. The order of the other reference voltage signal lines, placement of each transistor, a connection relationship between each transistor and each reference voltage signal line, and a relationship of a reference voltage signal supplied from each reference voltage signal line are the same as those in FIGS. 4A and 4B. The reference voltage signal line 71-3 on the metal layer 71 is placed on a lower side of the TH 61 in the drawing of FIG. 6A. The TH 61 is connected to the node N16 of the switch transistor 24, and a connection portion to the TH 61 is provided from the reference voltage signal line 71-3. The reference voltage signal line 71-4 is placed on an upper side of the TH 61 in the drawing of FIG. 6A. The TH61 is connected to the node N26 of the switch transistor 34, and a connection portion to the TH61 is provided from the reference voltage signal line 71-4. The variation example in FIGS. 6A and 6B can also obtain the similar effect to that which can be implemented by the layouts of FIGS. 4A and 4B.

Figure 7A:
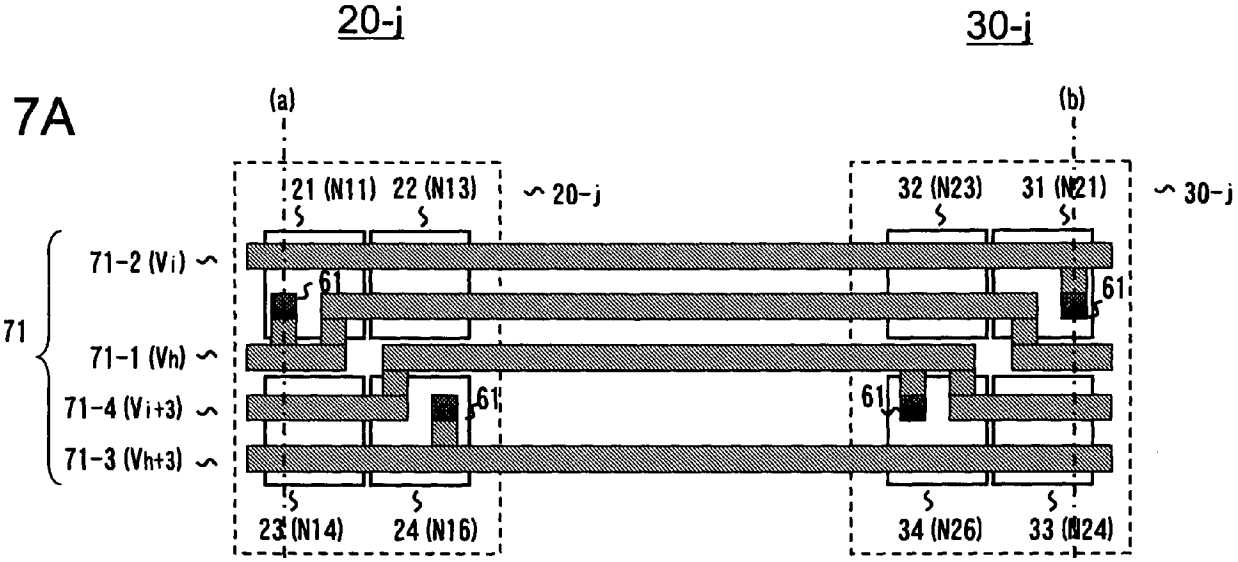
FIGS. 7A and 7B are diagrams each showing another layout configuration of the metal layer in the example of the present invention.
Figure 7B:
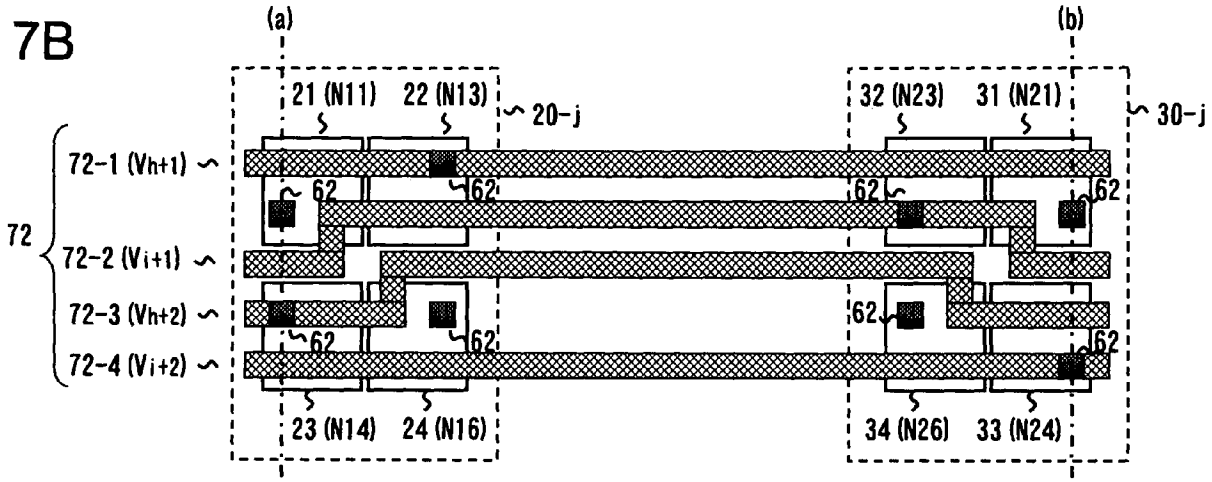

FIGS. 7A and 7B are diagrams showing a third variation example of the example in FIGS. 4A and 4B. FIGS. 7A and 7B show interconnect patterns in which the order of the reference voltage signal lines 71-1 and 71-2 on the metal layer 71 in FIGS. 4A and 4B is interchanged, and the order of the reference voltage signal lines 71-3 and 71-4 is also interchanged. The order of the other reference voltage signal lines, placement of each transistor, a connection relationship between each transistor and each reference voltage signal line, and a relationship of a reference voltage signal supplied from each reference voltage signal line are the same as those in FIGS. 4A and 4B. The variation example in FIGS. 7A and 7B can also obtain the similar effect to that which can be implemented by the layouts of FIGS. 4A and 4B.

Figure 8A:
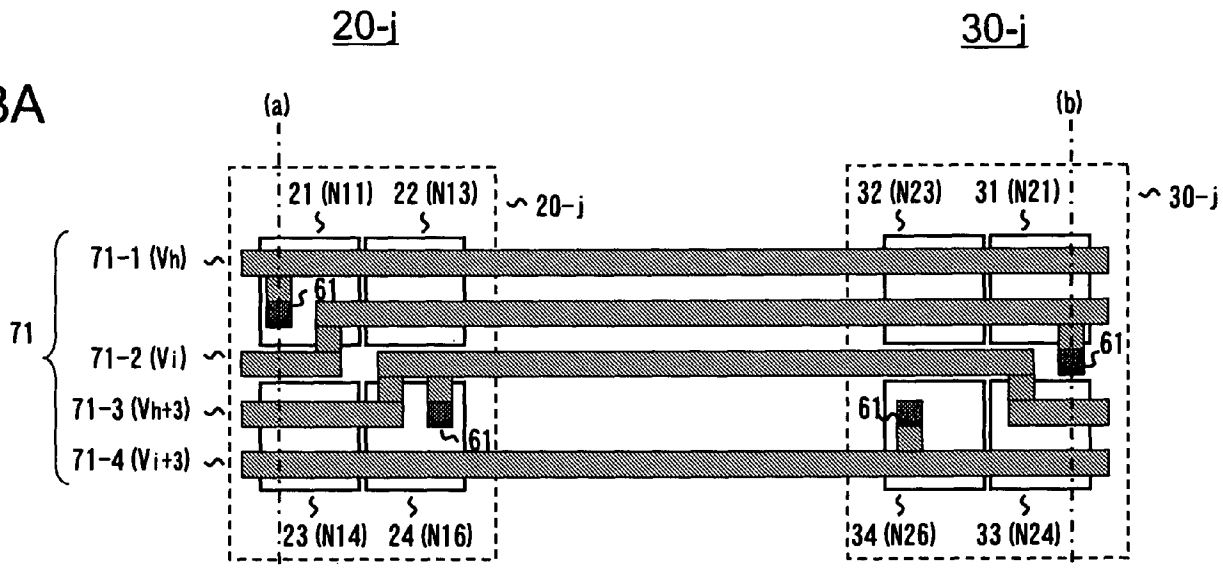
FIGS. 8A and 8B are diagrams each showing another layout configuration of the metal layer in the example of the present invention.
Figure 8B:
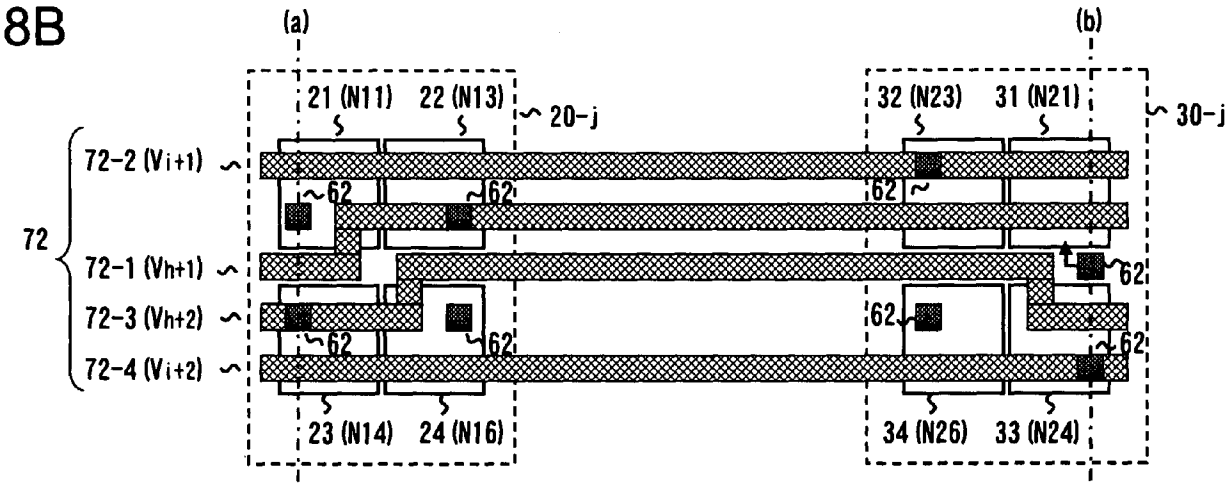

FIGS. 8A and 8B are diagrams showing a fourth variation example of the example in FIGS. 4A and 4B. FIGS. 8A and 8B show interconnect patterns in which the order of the reference voltage signal lines 72-1 and 72-2 on the metal layer 72 in FIGS. 4A and 4B is interchanged. The order of the other reference voltage signal lines, placement of each transistor, a connection relationship between each transistor and each reference voltage signal line, and a relationship of a reference voltage signal supplied from each reference voltage signal line are the same as those in FIGS. 4A and 4B. The variation example in FIGS. 8A and 8B can also obtain the similar effect to that which can be implemented by the layouts of FIGS. 4A and 4B.

Figure 9A:
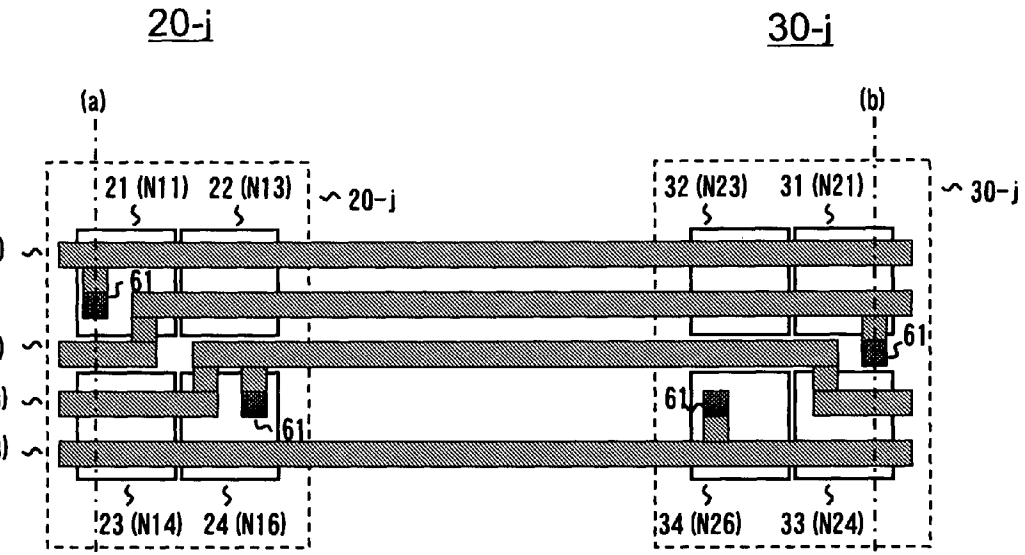
FIGS. 9A and 9B are diagrams each showing another layout configuration of the metal layer in the example of the present invention.
Figure 9B:
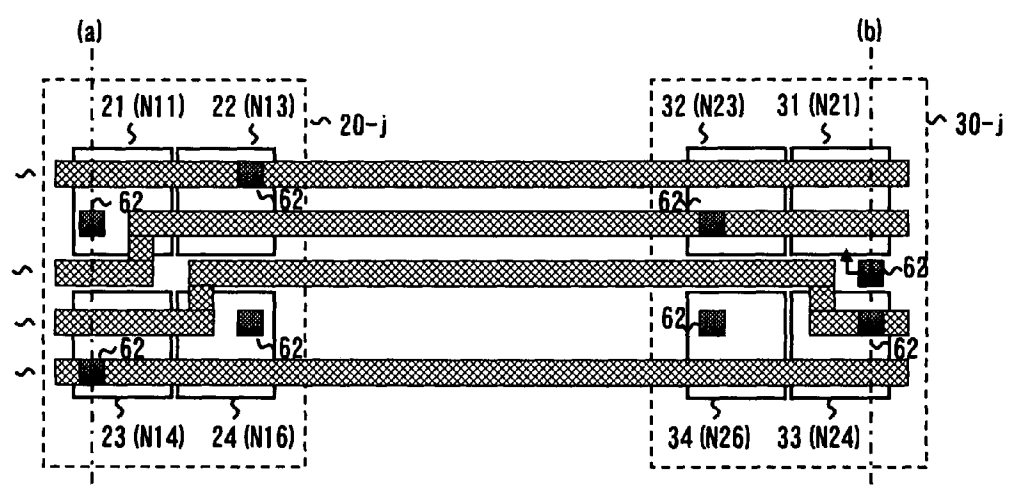

FIGS. 9A and 9B are diagrams showing a fifth variation example of the example in FIGS. 4A and 4B. FIGS. 9A and 9B show interconnect patterns in which the order of the reference voltage signal lines 72-3 and 72-4 on the metal layer 72 in FIGS. 4A and 4B is interchanged. The order of the other reference voltage signal lines, placement of each transistor, a connection relationship between each transistor and each reference voltage signal line, and a relationship of a reference voltage signal supplied from each reference voltage signal line are the same as those in FIGS. 4A and 4B. The variation example in FIGS. 9A and 9B can also obtain the similar effect to that which can be implemented by the layouts of FIGS. 4A and 4B.

Figure 10A:
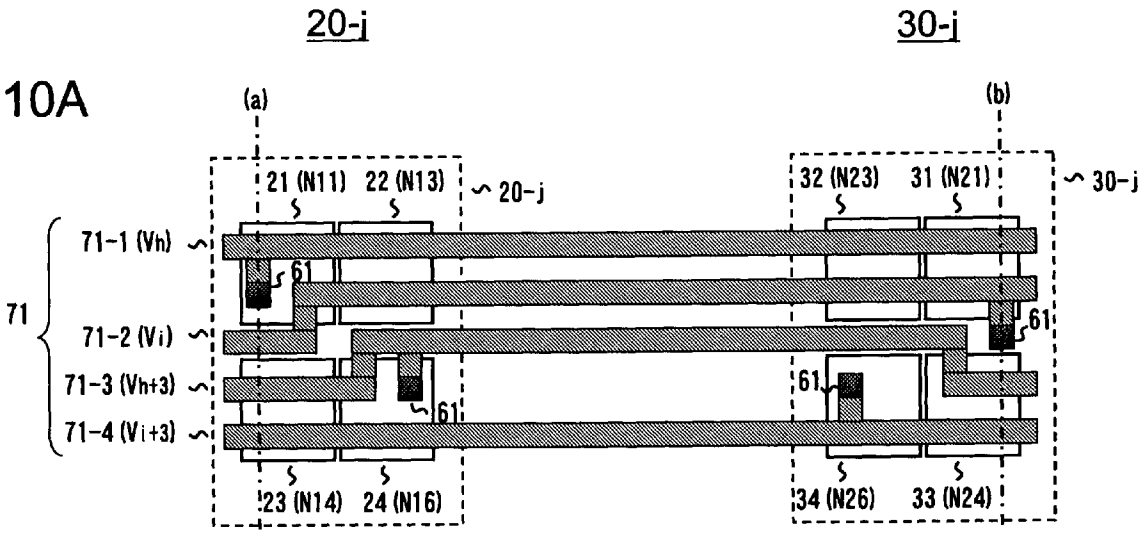
FIGS. 10A and 10B are diagrams each showing another layout configuration of the metal layer in the example of the present invention.
Figure 10B:
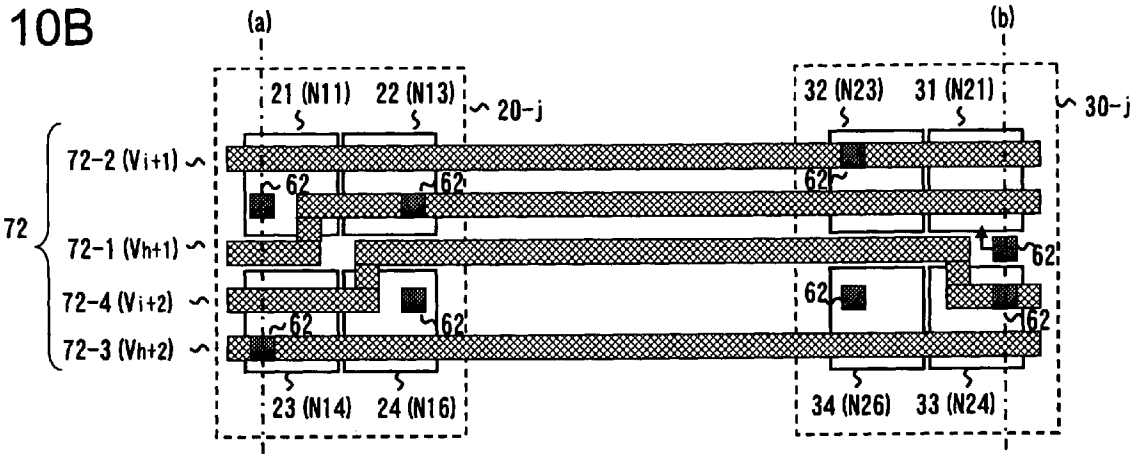

FIGS. 10A and 10B are diagrams showing a sixth variation example of the example in FIGS. 4A and 4B. FIGS. 10A and 10B show interconnect patterns in which the order of the reference voltage signal lines 72-1 and 72-2 on the metal layer 72 in FIGS. 4A and 4B is interchanged, and the order of the reference voltage signal lines 72-3 and 72-4 is also interchanged. The order of the other reference voltage signal lines, placement of each transistor, a connection relationship between each transistor and each reference voltage signal line, and a relationship of a reference voltage signal supplied from each reference voltage signal line are the same as those in FIGS. 4A and 4B. The variation example in FIGS. 10A and 10B can also obtain the similar effect to that which can be implemented by the layouts of FIGS. 4A and 4B.

Figure 11A:
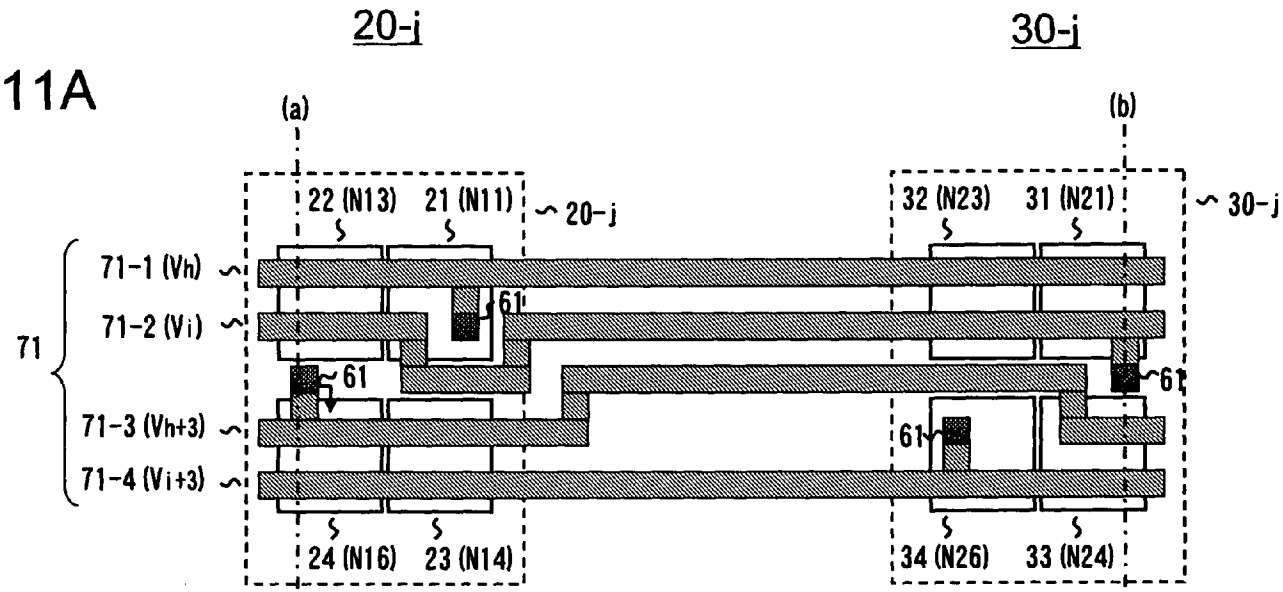
FIGS. 11A and 11B are diagrams each showing another layout configuration of the metal layer in the example of the present invention.
Figure 11B:
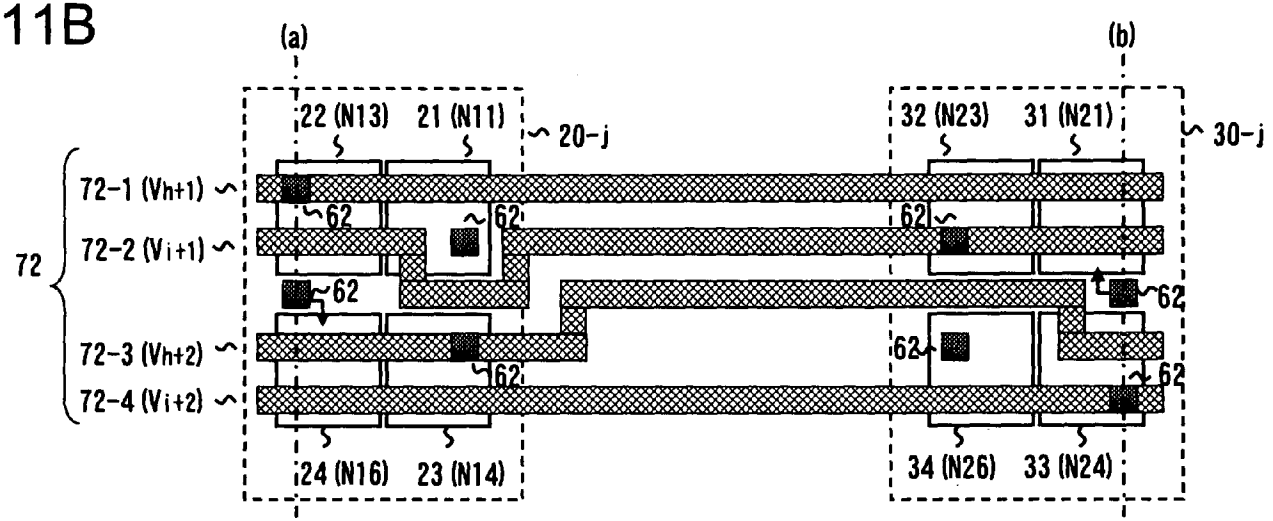

FIGS. 11A and 11B are diagrams showing a sixth variation example of the example shown in FIGS. 4A and 4B. FIGS. 11A and 11B shows configurations in which placement of columns of the switch transistors in the selection circuit portion 20-*j* in FIGS. 4A and 4B is interchanged. Placements of the switch transistors 21 and 22 are interchanged, and placements of the switch transistors 23 and 24 are interchanged. The reference voltage signal line 71-2 is linearly extended, circumvents the TH 61 connected to the node N11, and is then linearly extended again. With this arrangement, placements of the THs 61 and 62 that connect the switch transistors 21 to 24 to the corresponding reference voltage signal lines are a little changed. The order of the respective reference voltage signal lines, a connection relationship between each transistor and each of the reference voltage signal lines 71-1 to 71-4 and 72-1 to 72-4, and a relationship of a reference voltage signal supplied from each reference voltage signal line are the same as those in FIGS. 4A and 4B.

Even in the interconnect patterns of the present invention in which the order of the reference voltage signal lines 71-1 and 71-2 on the metal layer 71 is interchanged, the similar effect to that which can be implemented by the layouts of FIGS. 4A and 4B can be obtained.

The layouts shown in FIGS. 11A and 11B correspond to a configuration in which placement of a column of the switch transistors including the switch transistors 21 and 23 and placement of a column of the switch transistors including the switch transistors 22 and 24 in FIG. 3 are interchanged, and data signals (DXB, DX) that will be supplied to gates of the switch transistors are interchanged. Even if the columns of the switch transistors are interchanged in this manner, the resulting decoder is equivalent in terms of circuit operation. Thus, a result of reference voltage signal selection is not affected by transposition of the columns of the switch transistors.

That is, in this exemplary embodiment, layouts may also be made where placements of columns of the switch transistors in the selection circuit portion 30-*j* in FIGS. 4A and 4B are interchanged, as in FIGS. 11A and 11B. Layouts may be made where placements of the columns of the switch transistors in each of the selection circuit portions 20-*j* and 30-*j* in FIGS. 4A and 4B are interchanged. Illustration of these layouts is omitted. A layout may be made where placements of the columns of the switch transistors in the selection circuit portion 20-*j* or 30-*j* are interchanged for each of FIGS. 5A and 5B to 10A and 10B as well as FIGS. 4A and 4B. Each of the variation examples can achieve the similar effect to that which can be implemented by the layouts of FIGS. 4A and 4B.

Figure 12:
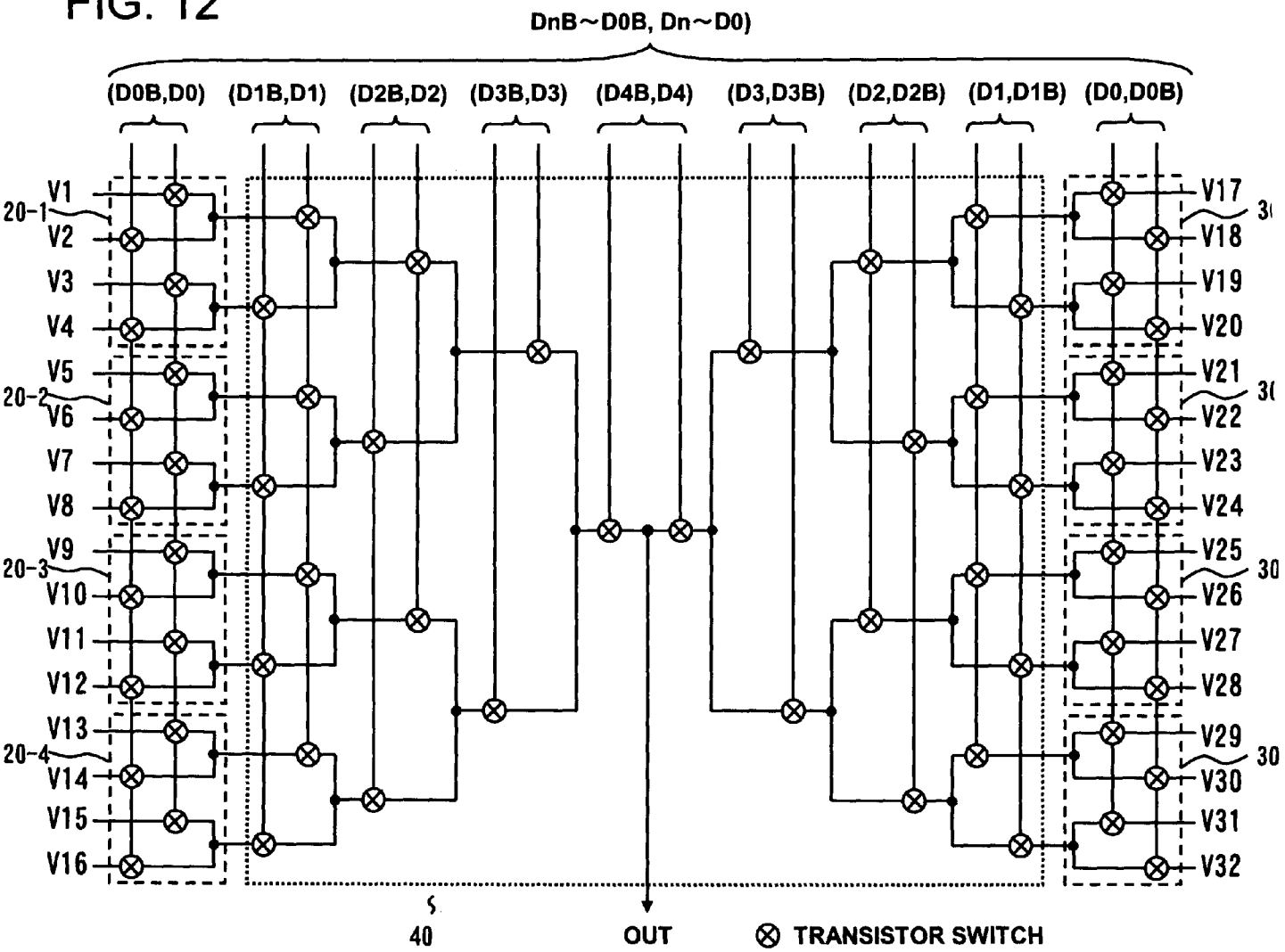
FIG. 12 is a diagram showing a configuration of a tournament type decoder to which the present invention can be applied.
Figure 13:
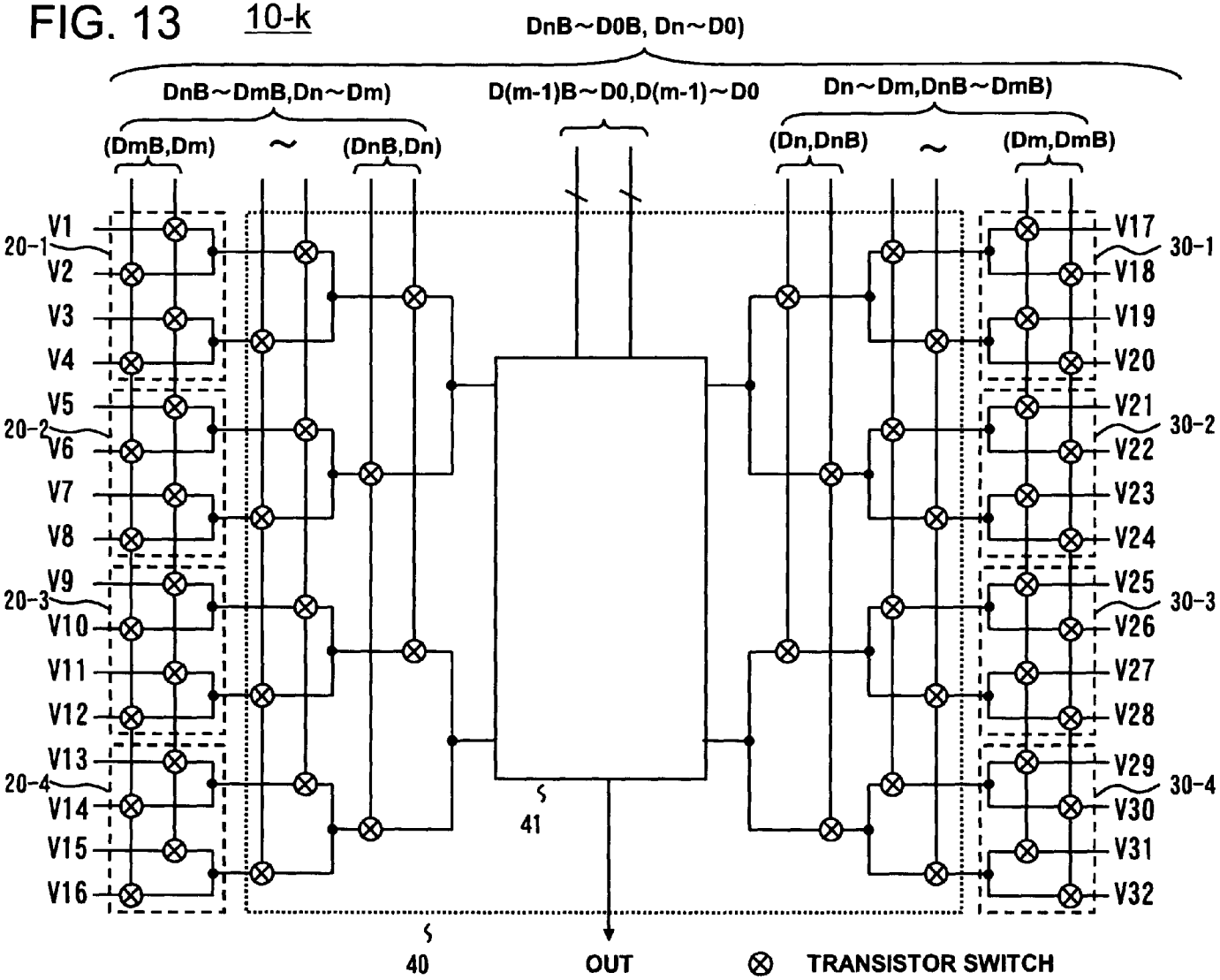
FIG. 13 is a diagram showing another configuration of the tournament type decoder to which the present invention can be applied.

Each of FIGS. 12 and 13 is a diagram showing a configuration of the exemplary embodiment of the present invention. Each of FIGS. 12 and 13 shows a specific example of the selection circuit unit 40 in the decoder in FIG. 2.

FIG. 12 shows a specific example of the decoder that is a tournament type decoder of (n+1) bits, where n=4. Each of the selection circuit portions 20-*j* and 30-*j* (where j is one of integers from 1 to 4) includes switch transistors that are selected by a least significant bit (D0B, D0) of the tournament type decoder. The reference voltage signal is supplied to one end of each switch transistor. The selection circuit unit 40 includes a tournament circuit selected by bits (D1B, D1) to (D4B, D4), and one selected reference voltage signal is output to a terminal OUT. Also in case n is other than 4 (in which n is equal to or more than one), a tournament type decoder can be configured based on the similar principle.

FIG. 13 is a diagram showing a configuration of a decoder of (n+1) bits that includes a plurality of tournament circuits of (m−n+1) bits from a low-order bit (DmB, Dm) to a most significant bit (DnB, Dn). Each of the selection circuit portions 20-*j* and 30-*j* (in which j is one of integers from 1 to 4) includes switch transistors selected by the low-order bit (DmB, Dm) of the tournament type decoder. The reference voltage signal is supplied to one end of each switch transistor. At least one of the reference voltage signals that is selected by the tournament circuits of (m−n+1) bits is selected according to bits (D0B, D0) to (D(m−1)B, D(m−1)) at a selection circuit 41. The selected reference voltage signal is then output to a terminal OUT. The selection circuit unit 40 includes the selection circuit 41 and a portion excluding the selection switches that use the bit (DmB, Dm) for the tournament circuits of (m−n+1) bits. The reference voltage signal that will be output to the terminal OUT is set to one or a plurality of reference voltage signals according to configurations of amplifier circuits 12-1 to 12-*q* in FIG. 1.

Figure 14:
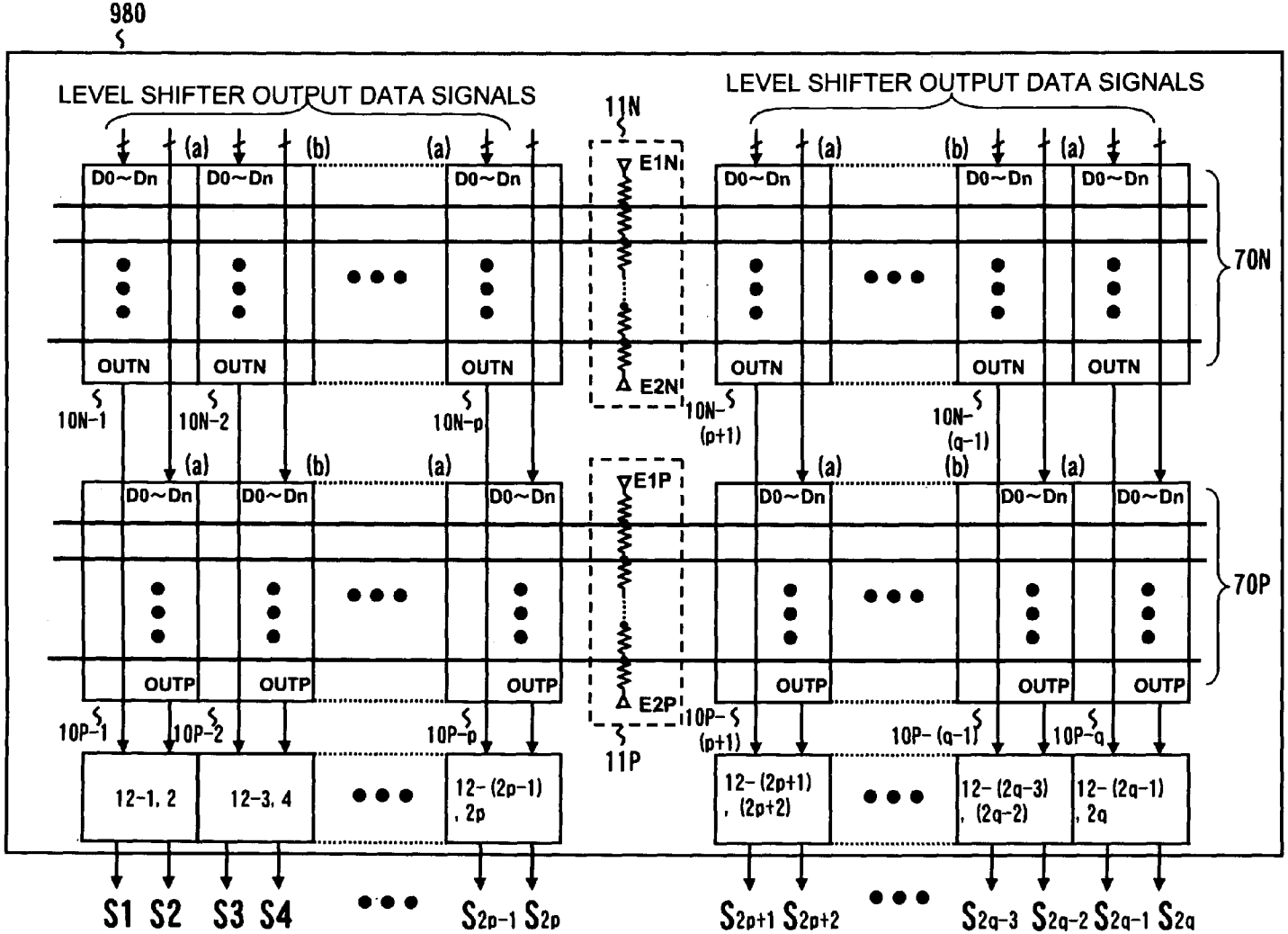
FIG. 14 is a diagram showing a configuration of another exemplary embodiment of the present invention.

FIG. 14 is a diagram showing a configuration example of a data driver 980 to which the present invention has been applied, and shows an example that is different from the exemplary embodiment in FIG. 1. The data driver shown in FIG. 14 includes decoders of two conductivity types including a decoder group 10P (comprising q decoders 10P-1, 10P-2, . . . 10P-p, 10P-(p+1), . . . and 10P-q) formed of P-channel type transistors and a decoder group 10N (comprising q decoders 10N-1, 10N-2, . . . 10N-p, 10N-(p+1), . . . 10N-q) formed of N-channel type transistors. Reference voltage generation circuits 11P and 11N are respectively provided for the decoder group 10P of a P conductivity type and the decoder group 10N of an N conductivity type.

Reference voltage signals of a plurality of levels from the reference voltage generation circuit 11P are supplied to the decoders 10P-1 to 10P-q through common reference voltage signal lines 70P. Reference voltage signals of a plurality of levels from the reference voltage generation circuit 11N are supplied to the decoders 10N-1 to 10N-q through common reference voltage signal lines 70N. The reference voltage signals selected respectively by the decoders 10N-1 and 10P-1 are supplied to amplifier circuits 12-1, 2, amplified, and then output to output terminals S1 and S2, respectively.

When a gray scale voltage signal corresponding to the reference voltage signal selected by the decoder 10N-1 is output (straight output) to the output terminal S1 in the amplifier circuit 12-1, 2, a gray scale voltage signal corresponding to the reference voltage signal selected by the decoder 10P-1 is output to the output terminal S2 of the amplifier circuit 12-1, 2. Alternatively, when the gray scale voltage signal corresponding to the reference voltage signal selected by the decoder 10N-1 is output to the output terminal S2, the gray scale voltage signal corresponding to the reference voltage signal selected by the decoder 10P-1 is output (cross output) to the output terminal S1.

Similarly, the reference voltage signals respectively selected by the decoder group 10N-2 and 10P-2 are respectively supplied to an amplifier circuit 12-3, 4, amplified, and subjected to straight or cross output to output terminals S3 and S4. Similarly, the reference voltage signals respectively selected by the decoders 10N-q and 10P-q are respectively supplied to an amplifier circuit 12-(2*q*-1), 2*q*, amplified, and subjected to straight or cross output to output terminals S2*q*-1 and S2*q*. By applying the configuration and the layout pattern shown in each of FIGS. 2 to 13 to the respective decoder group 10P-1 to 10P-q and the respective decoder group 10N-1 to 10P-q in FIG. 14, area saving can be achieved by the effect described with reference to each drawing.

Modifications and adjustments of the exemplary embodiment and the examples are possible within the scope of the overall disclosure (including claims) of the present invention, and based on the basic technical concept of the invention. Various combinations and selections of various disclosed elements are possible within the scope of the claims of the present invention. That is, the present invention of course includes various variations and modifications that could be made by those skilled in the art according to the overall disclosure including the claims and the technical concept.

What is claimed is:

1. A semiconductor device comprising:

a first region including first, second, third, and fourth transistors, arranged in a 2×2 matrix, wherein, relating to a row and a column of the 2×2 matrix in which the first transistor is arranged, the second transistor is arranged in the same row and the other column, the third transistor is arranged in the other row and the same column, and the fourth transistor is arranged in the other row and the other column;

first and second signal lines arranged on a first interconnect layer, the first and second signal lines being separated to each other and extended in the row direction over the 2×2 matrix; and third and fourth signal lines arranged on a second interconnect layer which is different from the first interconnect layer, the third and fourth signal lines being separated to each other and extended in the row direction over the 2×2 matrix, the first and second signal lines and the third and fourth signal lines being provided in association with the first region;

the first transistor having a first impurity diffusion layer connected to the first signal line on the first interconnect layer, the second transistor having a first impurity diffusion layer connected to the third signal line on the second interconnect layer, the third transistor having a first impurity diffusion layer connected to the fourth signal line on the second interconnect layer, and the fourth transistor having a first impurity diffusion layer connected to the second signal line on the first interconnect layer, wherein the first and third transistors have respective gate electrodes connected in common to a first binary input signal, the second and fourth transistors have respective gate electrodes connected in common to a second binary input signal, the first and second input signals are complementary to each other, the first and second transistors have second impurity diffusion layers coupled together at a first node, a signal on the first signal line or the third signal line being transmitted to the first node via the first or second transistor which is made conductive responsive to the first and second binary input signals, and the third and fourth transistors have second impurity diffusion layers coupled together at a second node, a signal on the second signal line or the fourth signal line being transmitted to the second node via the third or fourth transistor which is made conductive responsive to the first and second binary input signals.

2. The semiconductor device according to claim 1, further comprising a second region having fifth to eighth transistors arranged in a 2×2 matrix, wherein, relating to a row and a column of the 2×2 matrix in which the fifth transistor is arranged, the sixth transistor is arranged in the same row and the other column, the seventh transistor is arranged in the other row and the same column, and the eighth transistor is arranged in the other row and the other column;

fifth and sixth signal lines arranged on the first interconnect layer, the fifth and sixth signal lines being separated to each other and extended in the row direction over the 2×2 matrix; and seventh and eighth signal lines arranged on the second interconnect layer, the seventh and eighth signal lines being separated to each other and extended in the row direction over the 2×2 matrix, the fifth and sixth signal lines and the seventh and eighth signal lines being provided in association with the second region;

the fifth transistor having a first impurity diffusion layer connected to the fifth signal line on the first interconnect layer, the sixth transistor having a first impurity diffusion layer connected to the seventh signal line on the second interconnect layer, the seventh transistor having a first impurity diffusion layer connected to the eighth signal line on the second interconnect layer, and the eighth transistor having a first impurity diffusion layer connected to the sixth signal line on the first interconnect layer, wherein the fifth and seventh transistors have respective gate electrodes connected in common to a third binary input signal, the sixth and eighth transistors have respective gate electrodes connected in common to a fourth binary input signal, the third and fourth input signals are complementary to each other, the fifth transistor and the sixth transistor have second impurity diffusion layers coupled together at a third node, a signal on the fifth signal line or the seventh signal line being transmitted to the third node via the fifth or sixth transistor which is made conductive responsive to the third and fourth binary input signals, and the seventh transistor and the eighth transistor have second impurity diffusion layers coupled together at a fourth node, a signal on the sixth signal line or the eighth signal line being transmitted to the fourth node via the seventh or eighth transistor which is made conductive responsive corresponding to the third and fourth binary input signals.

3. The semiconductor device according to claim 1, wherein the first signal line on the first interconnect layer has a layout pattern which overlaps at least partially with a layout pattern of the third signal line on the second interconnect layer, and the second signal line on the first interconnect layer has a layout pattern which overlaps at least partially with a layout pattern of the fourth signal line on the second interconnect layer.

4. The semiconductor device according to claim 2, wherein the fifth signal line on the first interconnect layer has a layout pattern which overlaps at least partially with a layout pattern of the seventh signal line on the second interconnect layer, and the sixth signal line on the first interconnect layer has a layout pattern which overlaps at least partially with a layout pattern of the eighth signal line on the second interconnect layer.

5. The semiconductor device according to claim 2, wherein on the first interconnect layer above the first and second regions, the first signal line and the fifth signal line are adjacent to each other, and the second signal line and the sixth signal line on the first interconnect layer are adjacent to each other, and on the second interconnect layer above the first and second regions, the third signal line and the seventh signal line are adjacent to each other, and the fourth signal line and the eighth signal line on the second interconnect layer are adjacent to each other.

6. The semiconductor device according to claim 2, further comprising:

a decoder including:

one or a plurality of the 2×2 matrices in the first region arranged in the column direction thereof;

one or a plurality of the 2×2 matrices in the second region arranged in the column direction thereof; and a selection circuit unit that receives the signals at the first and second nodes of the first region and the signals at the third and fourth nodes of the second region and selects one of the signals on one or more the nodes, corresponding to a fifth binary input signal received, the selection circuit unit being arranged between the first and second regions.

7. The semiconductor device according to claim 6, comprising a plurality of the decoders arranged on an extension line in the row direction of the 2×2 matrices, wherein the decoder has the first and second regions respectively arranged on both sides of the decoder, with the selection circuit unit being arranged between the first and second regions, the decoder shares a first through-hole that is for connecting the first signal line on the first interconnect layer and the first impurity diffusion layer of the first transistor and a second through-hole that is for connecting the fourth signal line on the second interconnect layer and the first impurity diffusion layer of the third transistor with the decoder adjacently arranged on a side of the first region, and the decoder shares a third through-hole that is for connecting the fifth signal line on the first interconnect layer and the first impurity diffusion layer of the fifth transistor and a fourth through-hole that is for connecting the eighth signal line on the second interconnect layer and the first impurity diffusion layer of the seventh transistor with the decoder adjacently arranged on a side of the second region.

8. The semiconductor device according to claim 7, wherein the decoder and the adjacent decoder on the side of the first region share the respective first impurity diffusion layers of the first and third transistors, and the decoder and the adjacent decoder on the side of the second region share the respective first impurity diffusion layers of the fifth and seventh transistors.

9. The semiconductor device according to claim 6, wherein the first to fifth transistors in the first region and the fifth to eight transistors in the second region are arranged in a mirror symmetry, such that, in case the first transistor is arranged in a first row and a first column of the 2×2 matrix in the first region, the second transistor is arranged in the first row and a second column of the 2×2 matrix in the first region, the third transistor is arranged in a second row and the first column of the 2×2 matrix in the first region, and the fourth transistor is arranged in the second row and the second column of the 2×2 matrix in the first region, and that the fifth transistor is arranged in a first row and a second column of the 2×2 matrix in the second region, the sixth transistor is arranged in the first row and a first column of the 2×2 matrix in the second region, the seventh transistor is arranged in a second row and the second column of the 2×2 matrix in the second region, and the eighth transistor is arranged in the second row and the first column of the 2×2 matrix in the second region.

10. A data driver of a display apparatus, the data driver including:

a decoder that comprises the semiconductor device as set forth in claim 1, the decoder receiving a plurality of reference voltage signals and selecting one of the reference voltage signals based on a binary input signal.

11. A data driver comprising:

a decoder corresponding to one driver output;

a data signal with a predetermined number of bits and first to eighth signal lines;

a first region including first to fourth transistors adjacently arranged in a row direction and a column direction; and a second region including fifth to eighth transistors adjacently arranged in the row direction and the column direction;

the first to eighth signal lines comprising four signal lines on a first interconnect layer and four signal lines on a second interconnect layer which are placed over the four signal lines on a first interconnect layer, the first to fourth transistors in the first region being supplied with signals from two signal lines on the first interconnect layer and two signals from two signal lines on the second interconnect layer, the two signal lines on the first interconnect layer and the two signal lines on the second interconnect layer being among the first to eighth signal lines, a transistor pair among the adjacent transistor pairs which are adjacent in the row direction and adjacent transistor pairs which are adjacent in the column direction, being supplied with the signals from the interconnect layers that are different, signals being respectively supplied to the fifth to eight transistors in the second region through two of the signal lines on the first interconnect layer and two of the signal lines on the second interconnect layer different from the signal lines used for the first to fourth transistors, and a transistor pair among the adjacent transistor pairs which are adjacent in the row direction and adjacent transistor pairs which are adjacent in the column direction, being supplied with the signals from the interconnect layers that are different, the first to eight transistors selecting and outputting a signal corresponding to a predetermined bit data signal among the signals supplied through the first to eighth signal lines.

12. The data driver according to claim 11, wherein the four signal lines on the first interconnect layer are arranged adjacent to one another within the same interconnect layer and the four signal lines on the second interconnect layer are arranged adjacent to one another within the same interconnect layer.

13. The data driver according to claim 12, wherein the four signal lines on the first interconnect layer and the four signal lines on the second interconnect layer have overlapping potions in layout patterns thereof.

14. The data driver according to claim 11, wherein the first and second interconnect layers are provided above the first to eighth transistors in the first and second regions, a third interconnect layer is further provided as an intermediate layer between the first to eight transistors and the first and second interconnect layers, and the first to third interconnect layers are different from a layer of gates of the first to eighth transistors and include three interconnect layers close to the first to eighth transistors.

15. The data driver according to claim 11, wherein the decoder comprises:

a plurality of the decoders corresponding to a plurality of driver outputs, a plurality of the signal lines being shared between a plurality of the decoders.

* * * * *